US009722300B2

(12) United States Patent
Choi et al.

(10) Patent No.: US 9,722,300 B2
(45) Date of Patent: Aug. 1, 2017

(54) ANTENNA MODULE AND MOBILE TERMINAL USING THE SAME

(71) Applicant: LG ELECTRONICS INC., Seoul (KR)

(72) Inventors: Hyengcheul Choi, Seoul (KR); Jaehyun Choi, Seoul (KR); Chisang You, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 266 days.

(21) Appl. No.: 14/702,512

(22) Filed: May 1, 2015

(65) Prior Publication Data

US 2016/0164167 A1 Jun. 9, 2016

(30) Foreign Application Priority Data

Dec. 9, 2014 (KR) ..... 10-2014-0176142

(51) Int. Cl.
*H01Q 1/24* (2006.01)
*H01Q 7/00* (2006.01)
(Continued)

(52) U.S. Cl.
CPC ..... *H01Q 1/243* (2013.01); *H01Q 1/52* (2013.01); *H01Q 1/521* (2013.01); *H01Q 5/35* (2015.01);
(Continued)

(58) Field of Classification Search
CPC H01Q 1/243; H01Q 7/00; H01Q 1/38; H01Q 1/48; H01Q 3/26
(Continued)

(56) References Cited

U.S. PATENT DOCUMENTS

2011/0267245 A1 11/2011 Park et al.
2013/0069842 A1 3/2013 Lee et al.
(Continued)

FOREIGN PATENT DOCUMENTS

EP 2500979 9/2012
EP 2629361 8/2013

OTHER PUBLICATIONS

European Patent Office Application Serial No. 15001355.5, Search Report dated Sep. 21, 2016, 12 pages.
(Continued)

*Primary Examiner* — Joseph Lauture
(74) *Attorney, Agent, or Firm* — Lee Hong Degerman Kang & Waimey

(57) ABSTRACT

The present disclosure relates to an antenna module and a mobile terminal having the same, and the antenna module may include a conductive member, a first conductive arm formed at one side of the conductive member to form a first loop along with the conductive member so as to implement a first resonant frequency, a second conductive arm formed at the other side of the conductive member to form a second loop along with the conductive member so as to implement a second resonant frequency different from the first resonant frequency, a first feeding portion formed adjacent to the first conductive arm to feed the first conductive arm and conductive member, and a second feeding portion formed adjacent to the second conductive arm to feed the second conductive arm and conductive member.

29 Claims, 14 Drawing Sheets

(51) Int. Cl.

| | |
|---|---|
| ***H01Q 1/52*** | (2006.01) |
| ***H01Q 9/14*** | (2006.01) |
| ***H01Q 9/42*** | (2006.01) |
| ***H01Q 5/35*** | (2015.01) |
| *H01Q 3/26* | (2006.01) |
| *H01Q 1/48* | (2006.01) |
| *H01Q 1/38* | (2006.01) |

(52) U.S. Cl.
CPC ..... *H01Q 7/00* (2013.01); *H01Q 9/145* (2013.01); *H01Q 9/42* (2013.01); *H01Q 1/38* (2013.01); *H01Q 1/48* (2013.01); *H01Q 3/26* (2013.01)

(58) Field of Classification Search
USPC ..... 343/702, 700 MS, 748, 846, 848, 853; 455/575.1
See application file for complete search history.

(56) References Cited

U.S. PATENT DOCUMENTS

| | | | | |
|---|---|---|---|---|
| 2013/0328742 | A1* | 12/2013 | Hirobe ..... | H01Q 1/243 343/853 |
| 2014/0313089 | A1 | 10/2014 | Wu et al. | |
| 2014/0333495 | A1 | 11/2014 | Vazquez et al. | |

OTHER PUBLICATIONS

European Patent Office Application Serial No. 15001355.5, Search Report dated May 4, 2016, 9 pages.

* cited by examiner

ANTENNA MODULE AND MOBILE TERMINAL USING THE SAME

CROSS-REFERENCE TO RELATED APPLICATIONS

Pursuant to 35 U.S.C. §119(a), this application claims the benefit of earlier filing date and rights of priority to Korean Application 10-2014-0176142, filed on Dec. 9, 2014 the contents of which is incorporated by reference herein in its entirety.

BACKGROUND OF THE INVENTION

1. Field of the Invention

The present disclosure relates to a mobile terminal having an antenna module for transmitting and receiving wireless signals.

2. Description of the Related Art

Terminals may be generally classified into mobile/portable terminals or stationary terminals according to their mobility. Mobile terminals may also be classified as handheld terminals or vehicle mounted terminals according to whether or not a user can directly carry the terminal.

Mobile terminals have become increasingly more functional. Examples of such functions include data and voice communications, capturing images and video via a camera, recording audio, playing music files via a speaker system, and displaying images and video on a display. Some mobile terminals include additional functionality which supports game playing, while other terminals are configured as multimedia players. More recently, mobile terminals have been configured to receive broadcast and multicast signals which permit viewing of content such as videos and television programs.

As it becomes multifunctional, a mobile terminal can be allowed to capture still images or moving images, play music or video files, play games, receive broadcast and the like, so as to be implemented as an integrated multimedia player.

Various new attempts have been made in the aspect of hardware or software in order to support and enhance the function of such a mobile terminal.

Antenna as a device formed to transmit and receive wireless electromagnetic waves for wireless communication is a constituent element essentially required for a mobile terminal. A mobile terminal has a tendency to implement various functions such as LTE, DMB, and the like, in addition to voice calls, and therefore, an antenna should implement bandwidths satisfying the functions, and of course should be designed in a small size to be integrated into the mobile terminal.

A planar inverted-F antenna (PIFA), typically used in mobile terminals, has a narrow bandwidth, thus causing difficulties to obtain broadband antenna characteristics. According to the foregoing requirement, structural improvements for implementing a multi-band operation have been carried out.

Furthermore, due to the trend in mobile terminals, the size of a bezel has been gradually reduced, thereby resulting in an insufficient arrangement space of the antenna. In view of the circumstances, in recent years, mobile terminals using a metallic member itself forming an external appearance thereof as an antenna have been released on the market.

SUMMARY OF THE INVENTION

An aspect of the present disclosure is to solve the foregoing problem and other problems. Another aspect of the present disclosure is to propose a mobile terminal having an antenna apparatus capable of obtaining broadband characteristics.

The present disclosure is to propose a mobile terminal having a new structure configured to use a metallic member itself forming an external appearance of the mobile terminal as an antenna.

In order to accomplish the above and other objects, according to an aspect of the present disclosure, there may be provided an antenna module, including a conductive member, a first conductive arm formed at one side of the conductive member to form a first loop along with the conductive member so as to implement a first resonant frequency, a second conductive arm formed at the other side of the conductive member to form a second loop along with the conductive member so as to implement a second resonant frequency, a third conductive arm disposed between portions formed with the first conductive arm and the second conductive arm on the conductive member to isolate the first resonant frequency from the second resonant frequency, and a first feeding portion disposed between the first conductive arm and third conductive arm or between the second conductive arm and third conductive arm to feed the first conductive arm, second conductive arm and conductive member.

According to an aspect of the present invention, each of a first through a third matching module may be formed on the first through the third conductive arm, respectively.

According to an aspect of the present invention, the antenna module may further include a second feeding portion disposed between the first conductive arm and third conductive arm or between the second conductive arm and third conductive arm to feed the first conductive arm, second conductive arm and conductive member, wherein the second feeding portion is formed at both sides of the third conductive arm along with the first feeding portion.

According to an aspect of the present invention, the first feeding portion and second feeding portion may be connected by a conductive line.

According to an aspect of the present invention, each of the first through the third matching module may include a capacitor.

According to an aspect of the present invention, the conductive member may be earthed to the ground at at least one position on the outer side of portions formed with the first and the second conductive arm.

According to an aspect of the present invention, the position of the first and the second conductive arm may be formed at an end of the conductive member when the conductive member is earthed.

According to an aspect of the present invention, the third conductive arm and third matching module may form a notch filter.

According to an aspect of the present invention, the first and the second feeding portion may be formed more adjacent to the first conductive arm or second conductive arm.

According to an aspect of the present invention, each of the first resonant frequency and second resonant frequency may vary by the capacitor and a self inductance, respectively.

According to another aspect of the present invention, there may be provided an antenna module, including a conductive member, a first conductive arm formed at one side of the conductive member to form a first loop along with the conductive member so as to implement a first resonant frequency, a second conductive arm formed at the other side of the conductive member to form a second loop along with the conductive member so as to implement a second resonant frequency, and an indirect feeding portion configured to indirectly feed the first and the second conductive arm, wherein a first feeding element disposed adjacent to the first conductive arm to indirectly feed the first conductive arm and a second feeding element disposed adjacent to the second conductive arm to indirectly feed the second conductive arm are formed on the indirection feeding portion.

According to an aspect of the present invention, the indirect feeding portion may be formed more adjacent to the first conductive arm or second conductive arm.

According to an aspect of the present invention, the antenna module may further include a third conductive arm disposed between the first conductive arm and the second conductive arm of the conductive member to form a third loop along with the conductive member to isolate the first resonant frequency from the second resonant frequency.

According to an aspect of the present invention, a first through a third matching module may be formed on the first through the third conductive arm, respectively.

According to an aspect of the present invention, each of the first through the third matching module may include a capacitor.

According to an aspect of the present invention, a first and a second variable switch connected to the ground, respectively, may be formed on the first and the second feeding element to tune the first and the second resonant frequency.

According to an aspect of the present invention, each of the first and the second feeding element may include an inductor and a capacitor.

According to an aspect of the present invention, the first and the second feeding element may be disposed on a conductive connecting member connecting the first and the second feeding element to the indirect feeding portion.

According to an aspect of the present invention, the conductive may be earthed to the ground at at least one position on the outer side of portions formed with the first and the second conductive arm.

According to still another aspect of the present invention, there may be provided an antenna module, including a conductive member, a first conductive arm formed at one side of the conductive member to form a first loop along with the conductive member so as to implement a first resonant frequency, a second conductive arm formed at the other side of the conductive member to form a second loop along with the conductive member so as to implement a second resonant frequency different from the first resonant frequency, a first feeding portion formed adjacent to the second conductive arm to feed the second conductive arm and conductive member, and a second feeding portion formed adjacent to the first conductive arm to feed the first conductive arm and conductive member, wherein the first and the second resonant frequency are isolated by the first and the second feeding portion.

According to an aspect of the present invention, a first and a second matching module may be formed on the first through the second conductive arm, respectively.

According to an aspect of the present invention, the first and the second matching module may include a capacitor, respectively.

According to another aspect of the present invention, there may be provided a mobile terminal, including a terminal body, and an antenna module provided on the terminal body to implement a first resonant frequency and a second resonant frequency different from the first resonant frequency, wherein the antenna module includes a conductive member formed on a lateral outside of the terminal body, a first conductive arm formed at one side of the conductive member to form a first loop along with the conductive member so as to implement a first resonant frequency, a second conductive arm formed at the other side of the conductive member to form a second loop along with the conductive member so as to implement a second resonant frequency, and a feeding portion formed more adjacent to the first conductive arm or second conductive arm to feed the first conductive arm, second conductive arm and conductive member.

According to an aspect of the present invention, the mobile terminal may further include a third conductive arm disposed between the first conductive arm and the second conductive arm of the conductive member to form a third loop along with the conductive member to isolate the first resonant frequency from the second resonant frequency.

According to an aspect of the present invention, when the first conductive arm, second conductive arm and conductive member are directly fed, the feeding portion may include a first feeding portion disposed between the second conductive arm and third conductive arm and a second feeding portion disposed between the first conductive arm and third conductive arm.

According to an aspect of the present invention, when the first conductive arm, second conductive arm and conductive member are indirectly fed, the feeding portion may be an indirect feeding portion, and a first feeding element disposed adjacent to the first conductive arm to indirectly feed the first conductive arm and a second feeding element disposed adjacent to the second conductive arm to indirectly feed the second conductive arm may be connected to the indirect feeding portion.

According to an aspect of the present invention, the conductive member may be formed over part or all of the terminal body.

According to an aspect of the present invention, a first through a third matching module may be formed on the first through the third conductive arm, respectively.

According to an aspect of the present invention, each of the first through the third matching module may include a capacitor.

An antenna module according to the present disclosure and a mobile terminal using the same will be described as follows.

According to at least one of the embodiments of the present disclosure, there is an advantage in which a metal formed on a lateral appearance of the terminal body can be used as an antenna.

Furthermore, when an indirect feeding method is used, it has a wider feeding structure compared to direct feeding, thereby having less effect on a human body.

In addition, according to at least one of the embodiments of the present disclosure, frequencies having a wider band may be implemented using variable switches, thereby facilitating impedance adjustment with coupling control through the variable switches.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Description will now be given in detail according to the exemplary embodiments disclosed herein, with reference to the accompanying drawings. For the sake of brief description with reference to the drawings, the same or equivalent components will be provided with the same reference numbers, and description thereof will not be repeated. A suffix "module" and "unit" used for constituent elements disclosed in the following description is merely intended for easy description of the specification, and the suffix itself does not give any special meaning or function. In describing the present disclosure, if a detailed explanation for a related known function or construction is considered to unnecessarily divert the gist of the present disclosure, such explanation has been omitted but would be understood by those skilled in the art. The accompanying drawings are used to help easily understand the technical idea of the present disclosure and it should be understood that the idea of the present disclosure is not limited by the accompanying drawings. The idea of the present disclosure should be construed to extend to any alterations, equivalents and substitutes besides the accompanying drawings.

It will be understood that, although the terms first, second, etc. may be used herein to describe various elements, these elements should not be limited by these terms. These terms are only used to distinguish one element from another.

It will be understood that when an element is referred to as being "connected with" another element, the element can be directly connected with the other element or intervening elements may also be present. In contrast, when an element is referred to as being "directly connected with" another element, there are no intervening elements present.

A singular representation may include a plural representation as far as it represents a definitely different meaning from the context.

Terms 'include' or 'has' used herein should be understood that they are intended to indicate an existence of several components or several steps, disclosed in the specification, and it may also be understood that part of the components or steps may not be included or additional components or steps may further be included.

Mobile terminals described herein may include cellular phones, smart phones, laptop computers, digital broadcasting terminals, personal digital assistants (PDAs), portable multimedia players (PMPs), navigators, slate PCs, tablet PCs, ultra books, wearable devices (for example, smart watches, smart glasses, head mounted displays (HMDs)), and the like.

However, it may be easily understood by those skilled in the art that the configuration according to the exemplary embodiments of this specification can also be applied to stationary terminals such as digital TV, desktop computers and the like, excluding a case of being applicable only to the mobile terminals.

Figure 1A:
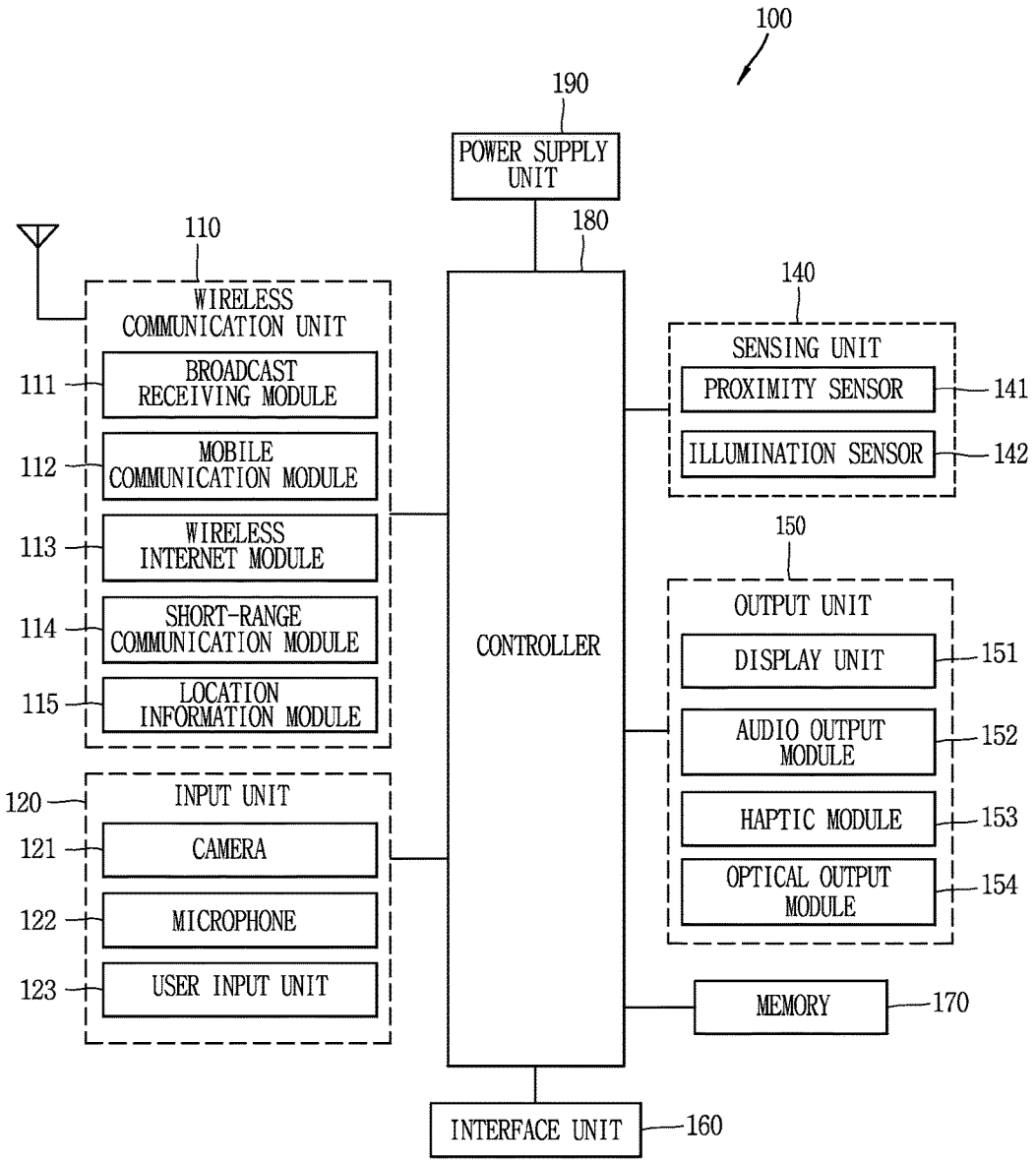
FIG. 1A is a block diagram for explaining a mobile terminal associated with the present disclosure.
Figure 1B:
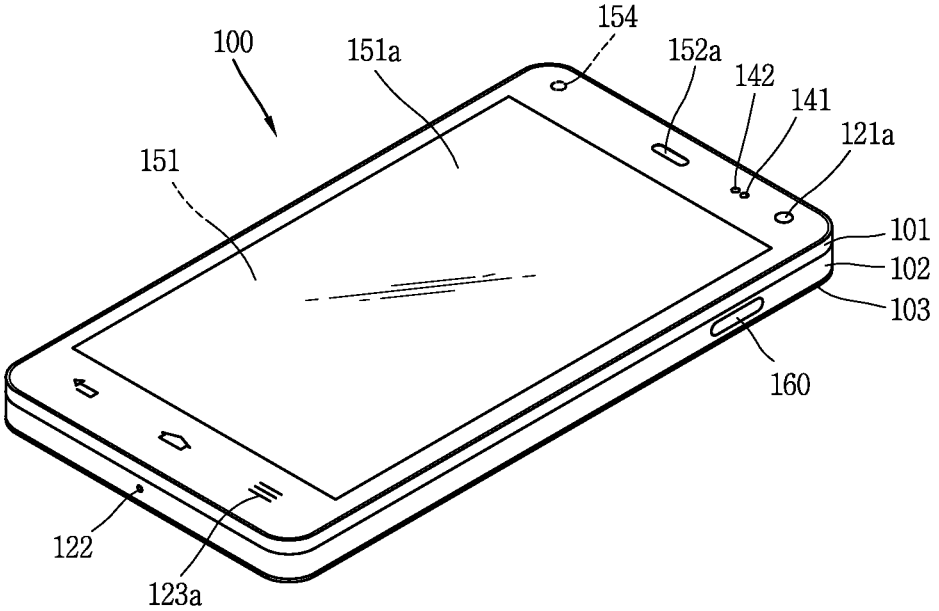
FIGS. 1B and 1C are conceptual views illustrating an example in which a mobile terminal associated with the present disclosure is seen from different directions.
Figure 1C:
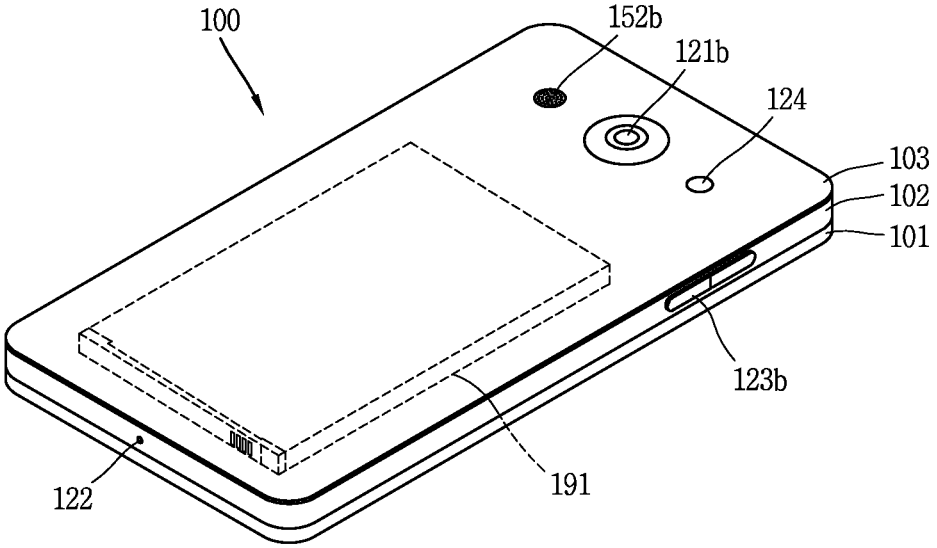

Referring to FIGS. 1A through 1C, FIG. 1A is a block diagram of a mobile terminal in accordance with the present disclosure, FIGS. 1B and 1C are conceptual views of one example of the mobile terminal, viewed from different directions.

The mobile terminal 100 may include components, such as a wireless communication unit 110, an input unit 120, a sensing unit 140, an output unit 150, an interface unit 160, a memory 170, a controller 180, a power supply unit 190 and the like. FIG. 1A illustrates the mobile terminal having various components, but it may be understood that implementing all of the illustrated components is not a requirement. Greater or fewer components may alternatively be implemented.

In more detail, the wireless communication unit 110 of those components may typically include one or more modules which permit wireless communications between the mobile terminal 100 and a wireless communication system, between the mobile terminal 100 and another mobile terminal 100, or between the mobile terminal 100 and a network within which another mobile terminal 100 (or an external server) is located.

For example, the wireless communication unit 110 may include at least one of a broadcast receiving module 111, a mobile communication module 112, a wireless Internet module 113, a short-range communication module 114, a location information module 115 and the like.

The input unit 120 may include a camera 121 for inputting an image signal, a microphone 122 or an audio input module for inputting an audio signal, or a user input unit 123 (for example, a touch key, a push key (or a mechanical key), etc.) for allowing a user to input information. Audio data or image data collected by the input unit 120 may be analyzed and processed by a user's control command.

The sensing unit 140 may include at least one sensor which senses at least one of internal information of the mobile terminal, a surrounding environment of the mobile terminal and user information. For example, the sensing unit 140 may include a proximity sensor 141, an illumination sensor 142, a touch sensor, an acceleration sensor, a magnetic sensor, a G-sensor, a gyroscope sensor, a motion sensor, an RGB sensor, an infrared (IR) sensor, a finger scan sensor, a ultrasonic sensor, an optical sensor (for example, refer to the camera 121), a microphone 122, a battery gage, an environment sensor (for example, a barometer, a hygrometer, a thermometer, a radiation detection sensor, a thermal sensor, a gas sensor, etc.), and a chemical sensor (for example, an electronic nose, a health care sensor, a biometric sensor, etc.). On the other hand, the mobile terminal disclosed herein may utilize information in such a manner of combining information sensed by at least two sensors of those sensors.

The output unit 150 may be configured to output an audio signal, a video signal or a tactile signal. The output unit 150 may include a display unit 151, an audio output module 152, a haptic module 153, an optical output module 154 and the like. The display unit 151 may have an inter-layered structure or an integrated structure with a touch sensor so as to implement a touch screen. The touch screen may provide an output interface between the mobile terminal 100 and a user, as well as functioning as the user input unit 123 which provides an input interface between the mobile terminal 100 and the user.

The interface unit 160 may serve as an interface with various types of external devices connected with the mobile terminal 100. The interface unit 160, for example, may include wired or wireless headset ports, external power supply ports, wired or wireless data ports, memory card ports, ports for connecting a device having an identification module, audio input/output (I/O) ports, video I/O ports, earphone ports, or the like. The mobile terminal 100 may execute an appropriate control associated with a connected external device, in response to the external device being connected to the interface unit 160.

The memory 170 may store a plurality of application programs (or applications) executed in the mobile terminal 100, data for operations of the mobile terminal 100, instruction words, and the like. At least some of those application programs may be downloaded from an external server via wireless communication. Some others of those application programs may be installed within the mobile terminal 100 at the time of being shipped for basic functions of the mobile terminal 100 (for example, receiving a call, placing a call, receiving a message, sending a message, etc.). On the other hand, the application programs may be stored in the memory 170, installed in the mobile terminal 100, and executed by the controller 180 to perform an operation (or a function) of the mobile terminal 100.

The controller 180 may typically control an overall operation of the mobile terminal 100 in addition to the operations associated with the application programs. The controller 180 may provide or process information or functions appropriate for a user in a manner of processing signals, data, information and the like, which are input or output by the aforementioned components, or activating the application programs stored in the memory 170.

The controller 180 may control at least part of the components illustrated in FIG. 1, in order to drive the application programs stored in the memory 170. In addition, the controller 180 may drive the application programs by combining at least two of the components included in the mobile terminal 100 for operation.

The power supply unit 190 may receive external power or internal power and supply appropriate power required for operating respective elements and components included in the mobile terminal 100 under the control of the controller 180. The power supply unit 190 may include a battery, and the battery may be an embedded battery or a replaceable battery.

At least part of those elements and components may be combined to implement operation and control of the mobile terminal or a control method of the mobile terminal according to various exemplary embodiments described herein. Also, the operation and control or the control method of the mobile terminal may be implemented in the mobile terminal in such a manner of activating at least one application program stored in the memory 170.

Referring to FIGS. 1B and 1C, the mobile terminal 100 disclosed herein may be provided with a bar-type terminal body. However, the present disclosure may not be limited to this, but also may be applicable to various structures such as watch type, clip type, glasses type or folder type, flip type, slide type, swing type, swivel type, or the like, in which two and more bodies are combined with each other in a relatively movable manner.

Here, the terminal body may be understood as a conception which indicates the mobile terminal 100 as at least one assembly.

The mobile terminal 100 may include a case (casing, housing, cover, etc.) forming the appearance of the terminal. In this embodiment, the case may be divided into a front case 101 and a rear case 102. Various electronic components may be incorporated into a space formed between the front case 101 and the rear case 102. At least one middle case may be additionally disposed between the front case 101 and the rear case 102

A display unit 151 may be disposed on a front surface of the terminal body to output information. As illustrated, a window 151*a* of the display unit 151 may be mounted to the front case 101 so as to form the front surface of the terminal body together with the front case 101.

In some cases, electronic components may also be mounted to the rear case 102. Examples of those electronic components mounted to the rear case 102 may include a detachable battery, an identification module, a memory card and the like. Here, a rear cover 103 for covering the electronic components mounted may be detachably coupled to the rear case 102. Therefore, when the rear cover 103 is detached from the rear case 102, the electronic components mounted to the rear case 102 may be externally exposed.

As illustrated, when the rear cover 103 is coupled to the rear case 102, a side surface of the rear case 102 may be partially exposed. In some cases, upon the coupling, the rear case 102 may also be completely shielded by the rear cover 103. On the other hand, the rear cover 103 may include an opening for externally exposing a camera 121*b* or an audio output module 152*b*.

The cases 101, 102, 103 may be formed by injection-molding synthetic resin or may be formed of a metal, for example, stainless steel (STS), titanium (Ti), or the like.

Unlike the example which the plurality of cases form an inner space for accommodating such various components, the mobile terminal 100 may be configured such that one case forms the inner space. In this example, a mobile terminal 100 having a uni-body formed in such a manner that synthetic resin or metal extends from a side surface to a rear surface may also be implemented.

On the other hand, the mobile terminal 100 may include a waterproofing unit (not shown) for preventing an introduction of water into the terminal body. For example, the waterproofing unit may include a waterproofing member which is located between the window 151*a* and the front case 101, between the front case 101 and the rear case 102, or between the rear case 102 and the rear cover 103, to hermetically seal an inner space when those cases are coupled.

The mobile terminal may include a display unit 151, first and second audio output modules 152*a* and 152*b*, a proximity sensor 141, an illumination sensor 152, an optical output module 154, first and second cameras 121*a* and 121*b*, first and second manipulation units 123*a* and 123*b*, a microphone 122, an interface unit 160 and the like.

Hereinafter, description will be given of an exemplary mobile terminal 100 that the display unit 151, the first audio output module 152*a*, the proximity sensor 141, the illumination sensor 142, the optical output module 154, the first camera 121*a* and the first manipulation unit 123*a* are disposed on the front surface of the terminal body, the second manipulation unit 123*b*, the microphone 122 and the interface unit 160 are disposed on a side surface of the terminal body, and the second audio output module 152*b* and the second camera 121*b* are disposed on a rear surface of the terminal body, with reference to FIGS. 1B and 1C.

Here, those components may not be limited to the arrangement, but be excluded or arranged on another surface if necessary. For example, the first manipulation unit 123*a* may not be disposed on the front surface of the terminal body, and the second audio output module 152*b* may be disposed on the side surface other than the rear surface of the terminal body.

The display unit 151 may output information processed in the mobile terminal 100. For example, the display unit 151 may display execution screen information of an application program driven in the mobile terminal 100 or user interface (UI) and graphic user interface (GUI) information in response to the execution screen information.

The display unit 151 may include at least one of a liquid crystal display (LCD), a thin film transistor-liquid crystal display (TFT-LCD), an organic light emitting diode (OLED), a flexible display, a 3-dimensional (3D) display, and an e-ink display.

The display unit 151 may be implemented in two or more in number according to a configured aspect of the mobile terminal 100. For instance, a plurality of the display units 151 may be arranged on one surface to be separated from or integrated with each other, or may be arranged on different surfaces.

The display unit 151 may include a touch sensor which senses a touch onto the display unit so as to receive a control command in a touching manner. When a touch is input to the display unit 151, the touch sensor may be configured to sense this touch and the controller 180 may generate a control command corresponding to the touch. The content which is input in the touching manner may be a text or numerical value, or a menu item which can be indicated or designated in various modes.

The touch sensor may be configured in a form of film having a touch pattern. The touch sensor may be a metal wire, which is disposed between the window 151*a* and a display (not shown) on a rear surface of the window 151*a* or patterned directly on the rear surface of the window 151*a*. Or, the touch sensor may be integrally formed with the display. For example, the touch sensor may be disposed on a substrate of the display or within the display.

The display unit 151 may form a touch screen together with the touch sensor. Here, the touch screen may serve as the user input unit 123 (see FIG. 1A). Therefore, the touch screen may replace at least some of functions of the first manipulation unit 123*a*.

The first audio output module 152*a* may be implemented in the form of a receiver for transferring voice sounds to the user's ear or a loud speaker for outputting various alarm sounds or multimedia reproduction sounds.

The window 151*a* of the display unit 151 may include a sound hole for emitting sounds generated from the first audio output module 152*a*. Here, the present disclosure may not be limited to this. It may also be configured such that the sounds are released along an assembly gap between the structural bodies (for example, a gap between the window 151*a* and the front case 101). In this case, a hole independently formed to output audio sounds may not be seen or hidden in terms of appearance, thereby further simplifying the appearance of the mobile terminal 100.

The optical output module 154 may output light for indicating an event generation. Examples of the event generated in the mobile terminal 100 may include a message reception, a call signal reception, a missed call, an alarm, a schedule notice, an email reception, information reception through an application, and the like. When a user's event checking is sensed, the controller may control the optical output unit 154 to stop the output of the light.

The first camera 121*a* may process video frames such as still or moving images obtained by the image sensor in a video call mode or a capture mode. The processed video frames may be displayed on the display unit 151 or stored in the memory 170.

The first and second manipulation units 123*a* and 123*b* are examples of the user input unit 123, which may be manipulated by a user to input a command for controlling the operation of the mobile terminal 100. The first and second manipulation units 123*a* and 123*b* may also be commonly referred to as a manipulating portion, and may employ any method if it is a tactile manner allowing the user to perform manipulation with a tactile feeling such as touch, push, scroll or the like.

The drawings are illustrated on the basis that the first manipulation unit 123*a* is a touch key, but the present disclosure may not be necessarily limited to this. For example, the first manipulation unit 123*a* may be configured with a mechanical key, or a combination of a touch key and a push key.

The content received by the first and second manipulation units 123*a* and 123*b* may be set in various ways. For example, the first manipulation unit 123*a* may be used by the user to input a command such as menu, home key, cancel, search, or the like, and the second manipulation unit 123*b* may be used by the user to input a command, such as controlling a volume level being output from the first or second audio output module 152*a* or 152*b*, switching into a touch recognition mode of the display unit 151, or the like.

On the other hand, as another example of the user input unit 123, a rear input unit (not shown) may be disposed on the rear surface of the terminal body. The rear input unit may be manipulated by a user to input a command for controlling an operation of the mobile terminal 100. The content input may be set in various ways. For example, the rear input unit may be used by the user to input a command, such as power on/off, start, end, scroll or the like, controlling a volume level being output from the first or second audio output module 152*a* or 152*b*, switching into a touch recognition mode of the display unit 151, or the like. The rear input unit may be implemented into a form allowing a touch input, a push input or a combination thereof.

The rear input unit may be disposed to overlap the display unit 151 of the front surface in a thickness direction of the terminal body. As one example, the rear input unit may be disposed on an upper end portion of the rear surface of the terminal body such that a user can easily manipulate it using a forefinger when the user grabs the terminal body with one hand. However, the present disclosure may not be limited to this, and the position of the rear input unit may be changeable.

When the rear input unit is disposed on the rear surface of the terminal body, a new user interface may be implemented using the rear input unit. Also, the aforementioned touch screen or the rear input unit may substitute for at least part of functions of the first manipulation unit 123*a* located on the front surface of the terminal body. Accordingly, when the first manipulation unit 123*a* is not disposed on the front surface of the terminal body, the display unit 151 may be implemented to have a larger screen.

On the other hand, the mobile terminal 100 may include a finger scan sensor which scans a user's fingerprint. The controller may use fingerprint information sensed by the finger scan sensor as an authentication means. The finger scan sensor may be installed in the display unit 151 or the user input unit 123.

The microphone 122 may be formed to receive the user's voice, other sounds, and the like. The microphone 122 may be provided at a plurality of places, and configured to receive stereo sounds.

The interface unit 160 may serve as a path allowing the mobile terminal 100 to exchange data with external devices. For example, the interface unit 160 may be at least one of a connection terminal for connecting to another device (for example, an earphone, an external speaker, or the like), a port for near field communication (for example, an Infrared Data Association (IrDA) port, a Bluetooth port, a wireless LAN port, and the like), or a power supply terminal for supplying power to the mobile terminal 100. The interface unit 160 may be implemented in the form of a socket for accommodating an external card, such as Subscriber Identification Module (SIM), User Identity Module (UIM), or a memory card for information storage.

The second camera 121*b* may be further mounted to the rear surface of the terminal body. The second camera 121*b* may have an image capturing direction, which is substantially opposite to the direction of the first camera unit 121*a*.

The second camera 121*b* may include a plurality of lenses arranged along at least one line. The plurality of lenses may also be arranged in a matrix configuration. The cameras may be referred to as an 'array camera.' When the second camera 121*b* is implemented as the array camera, images may be captured in various manners using the plurality of lenses and images with better qualities may be obtained.

A flash 124 may be disposed adjacent to the second camera 121*b*. When an image of a subject is captured with the camera 121*b*, the flash 124 may illuminate the subject.

The second audio output module 152*b* may further be disposed on the terminal body. The second audio output module 152*b* may implement stereophonic sound functions in conjunction with the first audio output module 152*a* (refer to FIG. 1A), and may be also used for implementing a speaker phone mode for call communication.

At least one antenna for wireless communication may be disposed on the terminal body. The antenna may be installed in the terminal body or formed on the case. For example, an antenna which configures a part of the broadcast receiving module 111 (see FIG. 1A) may be retractable into the terminal body. Alternatively, an antenna may be formed in a form of film to be attached onto an inner surface of the rear cover 103 or a case including a conductive material may serve as an antenna.

A power supply unit 190 for supplying power to the mobile terminal 100 may be disposed on the terminal body. The power supply unit 190 may include a batter 191 which is mounted in the terminal body or detachably coupled to an outside of the terminal body.

The battery 191 may receive power via a power source cable connected to the interface unit 160. Also, the battery 191 may be (re)chargeable in a wireless manner using a wireless charger. The wireless charging may be implemented by magnetic induction or electromagnetic resonance.

On the other hand, the drawing illustrates that the rear cover 103 is coupled to the rear case 102 for shielding the battery 191, so as to prevent separation of the battery 191 and protect the battery 191 from an external impact or foreign materials. When the battery 191 is detachable from the terminal body, the rear case 103 may be detachably coupled to the rear case 102.

An accessory for protecting an appearance or assisting or extending the functions of the mobile terminal 100 may further be provided on the mobile terminal 100. As one example of the accessory, a cover or pouch for covering or accommodating at least one surface of the mobile terminal 100 may be provided. The cover or pouch may cooperate with the display unit 151 to extend the function of the mobile terminal 100. Another example of the accessory may be a touch pen for assisting or extending a touch input onto a touch screen.

Hereinafter, embodiments associated with a control method which can be implemented in the mobile terminal having the foregoing configuration will be described with reference to the attached drawings. It should be understood by those skilled in the art that the present invention can be embodied in other specific forms without departing from the concept and essential characteristics thereof.

Figure 2A:
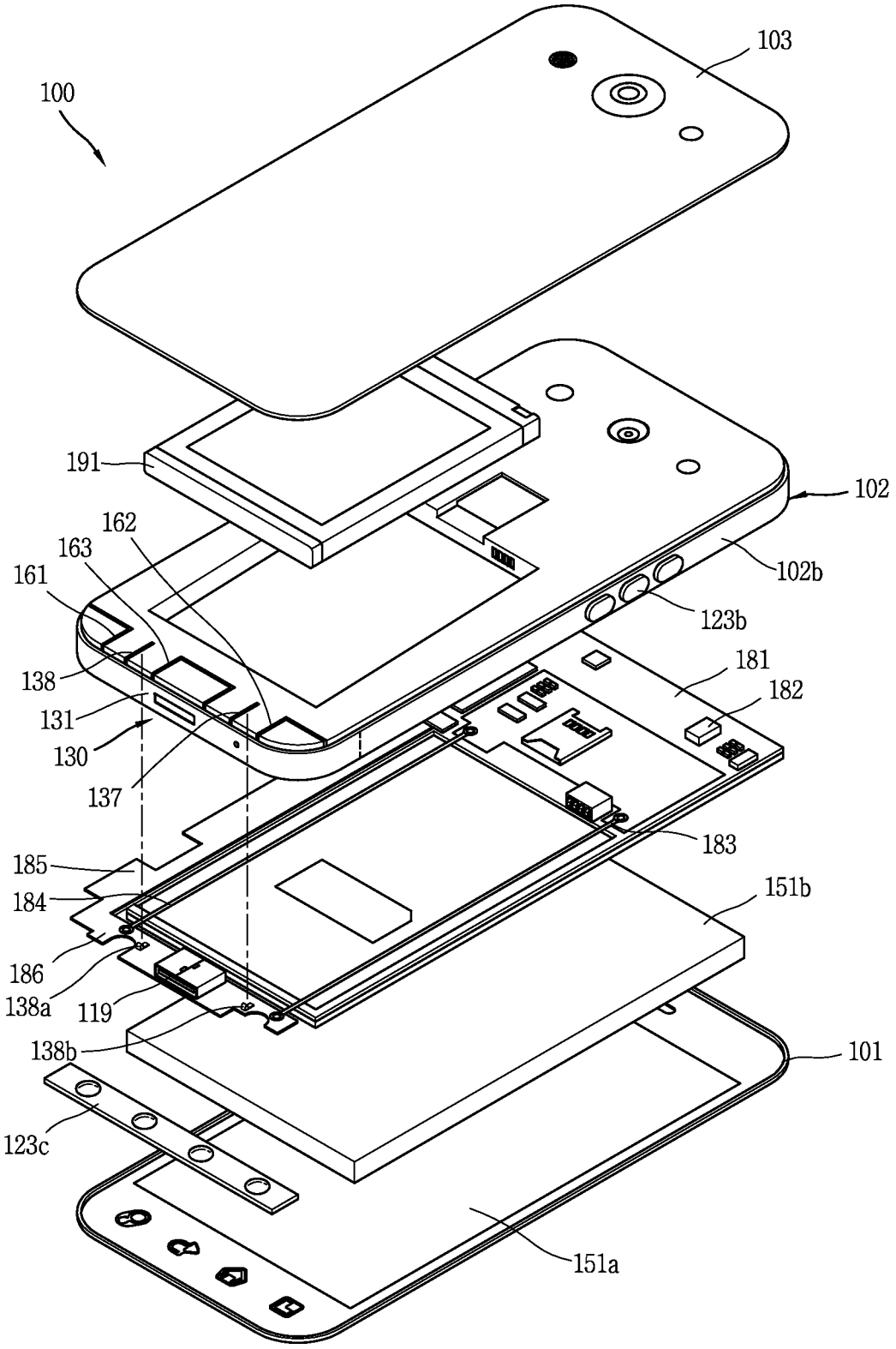
FIG. 2A is an exploded perspective view illustrating a mobile terminal associated with a first embodiment of the present disclosure.
Figure 2B:
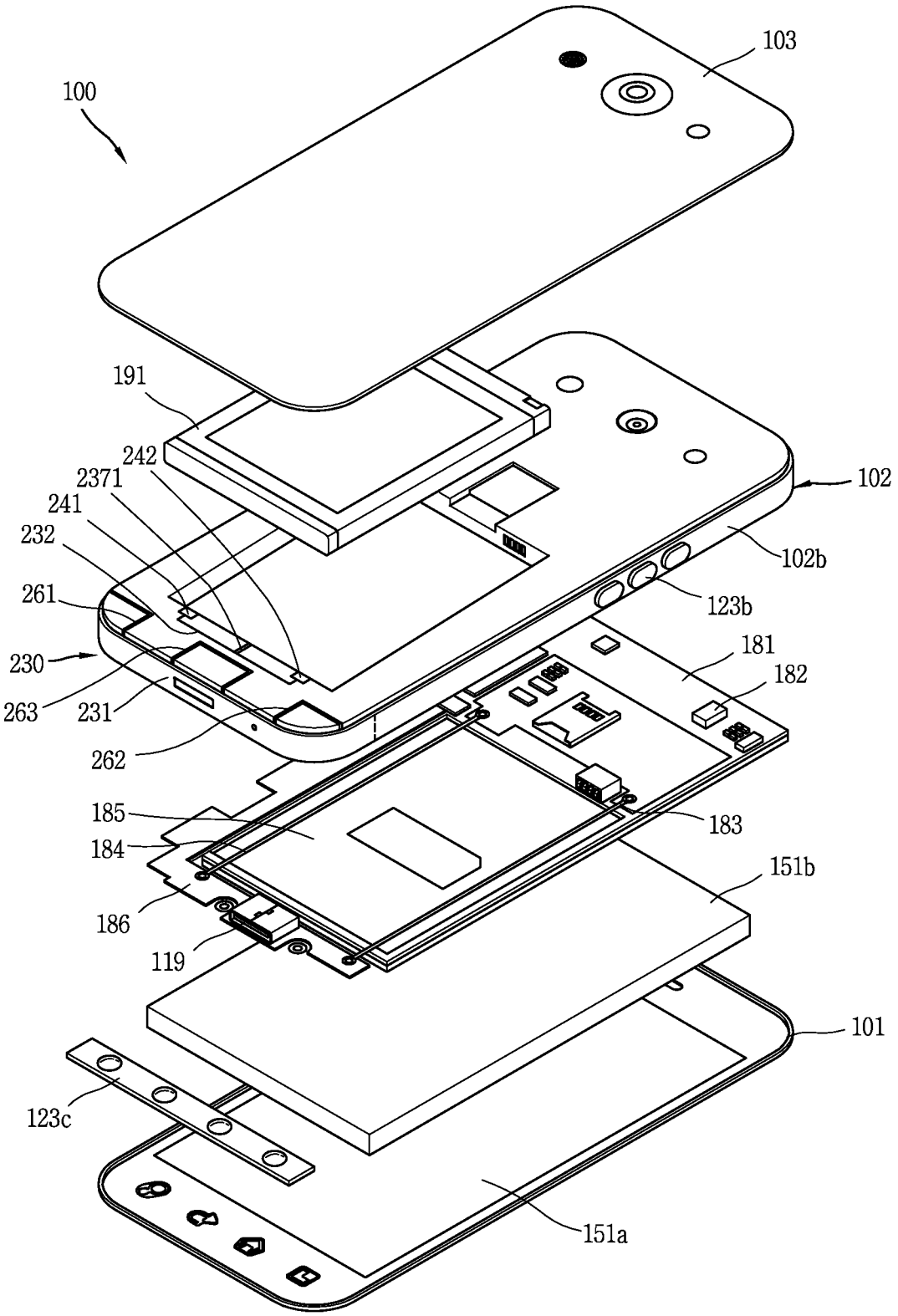
FIG. 2B is an exploded perspective view illustrating a mobile terminal associated with a second embodiment of the present disclosure.

First, FIGS. 2A and 2B are exploded perspective views illustrating a mobile terminal associated with an embodiment of the present disclosure, and will be described below with reference to FIGS. 2A and 2B.

The mobile terminal may include a window 151*a* and a display module 151*b* constituting the display unit 151. The window 151*a* may be coupled to one surface of the front case 101.

A frame 185 is formed to support electrical elements between the front case 101 and the rear case 102. As a supporting structure within the terminal, the frame 185 is formed to support at least any one of the display module 151*b*, camera module 121*b*, antenna module 130, battery 191 and circuit board 181 as an example.

Part of the frame 185 may be exposed to the outside of the terminal. Furthermore, the frame 185 may form part of a sliding module for connecting the body portion with the display unit in a slide type terminal other than a bar type terminal.

The drawings of FIGS. 2A and 2B illustrate an example in which the frame 185 is disposed between the rear case 102 and the circuit board 181, and the display module 151*b* is coupled to one surface of the circuit board 181. A rear cover 103 may be coupled to the rear case 102 to cover the battery 191. Here, the frame 185 is a component for enhancing the rigidity of the mobile terminal.

The window 151*a* is coupled to one surface of the front case 101. A touch sensor (not shown) may be mounted on the window 151*a*. The touch sensor is formed to sense a touch input, and made of a light transmitting material. The touch sensor is mounted on a front surface of the window 151*a*, and configured to convert a change of voltage or the like generated at a specific portion of the window 151*a* into an electrical input signal.

The display module 151*b* is mounted on a rear surface of the window 151*a*. As an example of the display module 151*b*, the present embodiment discloses a thin film transistor liquid crystal display (TFT LCD), but the present disclosure may not be necessarily limited to this.

For example, the display module 151*b* may be a liquid crystal display (LCD), an organic light-emitting device (OLED), a flexible display, a three-dimensional (3D) display or the like.

The circuit board 181 may be mounted at a lower portion of the display module 151*b*. Furthermore, at least one electrical element may be mounted on a lower surface of the circuit board 181.

The circuit board 181 may be a flexible circuit board and the board may be a dielectric substrate or semiconductor substrate, and the ground may be formed on either one surface of the substrate or any one layer thereof may be the ground when the substrate is a multi-layer substrate. Furthermore, a conductive member 131, 231, 331 according to an embodiment of the present disclosure may be bent along the circuit board 181, 281, 381 to correspond to a structure of terminal body.

In other words, as will be described later, the conductive member 131, 231, 331 according to an embodiment of the present disclosure may form a lateral appearance of the mobile terminal 100, wherein when the terminal body is bent, the conductive member 131, 231, 331 is also bent along therewith.

A recessed type of receiving portion may be formed on the frame 185 to accommodate the battery 191. A contact terminal connected to the circuit board 181 may be formed at one lateral surface of the rear case 102 or frame 185 to allow the battery 191 to supply power to the terminal body.

An antenna module may be formed at an upper end or lower end of the mobile terminal.

In general, a LTE/WCDMA Rx only antenna, a GPS antenna, a BT/WiFi antenna or the like may be used at an upper end of the mobile terminal, and a main antenna is used at a lower end of the mobile terminal.

An embodiment of the present disclosure relates to a main antenna, but may not be necessarily limited to this, and may transmit and receive at least one or more band frequencies of the LTE/WCDMA Rx only antenna, GPS antenna, BT/WiFi antenna based on its frequency band.

Furthermore, the foregoing antenna module may be formed in a plural number to be disposed at each end portion of the terminal, and each antenna module may be formed to transmit and receive wireless signals having different band frequencies.

The frame 185 may be formed of a metal material to maintain sufficient rigidity even if formed with a low thickness. The frame 185 with a metal material may be operated as ground. In other words, the circuit board 181 or antenna module 130 may be ground connected to the frame 185, and the frame 185 may be operated as the ground of the circuit board 181 or antenna module 130. In this case, the frame 185 may extend the ground of the mobile terminal.

Here, when the circuit board 181 is formed to occupy most area of the terminal body without being provided with the frame 185, the ground may be extended with the circuit board 181 itself.

The circuit board 181 may be electrically connected to the antenna module 130, and configured to process wireless signals (or wireless electromagnetic waves) transmitted and received by the antenna module 130. A plurality of transmitting and receiving circuits 182 may be formed or mounted on the circuit board 181 to process wireless signals.

The transmitting and receiving circuits may be formed to include one or more integrated circuits and their related electrical elements. For an example, a transmitting and receiving circuit may include a transmitting integrated circuit, a receiving integrated circuit, a switching circuit, an amplifier and the like.

A plurality of transmitting and receiving circuits may concurrently feed conductive members, which are radiators, to operate a plurality of antenna modules 130 at the same time. For example, while either one transmits signals, the other one may receive signals, and both ones transmit and receive signals.

The transmitting and receiving circuit may be formed in a plural number, and each transmitting and receiving circuit may be implemented in the form of a communication chip including at least one of a call processor CP), a modem chip, a RF transceiver chip and a RF receiver chip. Due to this, each communication chip may feed a conductive member through a feeding portion and a matching module (including a variable switch) to transmit wireless signals or receive wireless receiving signals received by the conductive member through the matching module (including a variable switch) and feeding portion so as to execute a predetermined receiving processing such as frequency conversion processing, demodulation processing or the like.

A coaxial cable 183, 184 connects the circuit board 181 and each antenna module 130 to each other. For an example, the coaxial cable 183, 184 may be connected to a feeding device for feeding the antenna module 130. The feeding devices may be formed on one surface of a flexible circuit board 186 formed to process signals received from the manipulation unit 123*a*. The other surface of the flexible circuit board 186 may be coupled to a signal transfer unit 123*c* formed to transfer a signal of the manipulation unit 123*a*. In this case, a dome is formed on the other surface of the flexible circuit board 186, and an actuator may be formed on the signal transfer unit 123*c*.

Furthermore, according to an embodiment of the present disclosure, there is provided an antenna module 130, 230, 330 for utilizing a metal edge forming an external appearance of the mobile terminal. For example, part or all of a lateral surface forming an external appearance of the mobile terminal may be used as an antenna.

Furthermore, according to an embodiment of the present disclosure, there is provided an antenna module 130, 230, 330 fed by a direct feeding or indirect feeding method to have multiple band frequencies and a mobile terminal 100 including the same.

The antenna module 130, 230, 330 according to an embodiment of the present disclosure may directly or indirectly feed the first conductive arm 161, 261, 361 and second conductive arm 162, 262, 362 disposed to be separated from each other to independently form a loop, thereby independently implementing a first resonant frequency and a second resonant frequency.

Hereinafter, it will be described that an antenna module in which the first conductive arm 161, second conductive arm 162 and third conductive arm 163 are provided therein and the first through the third conductive arm 161, 162, 163 are fed by one or more feeding portion 137, 138 is referred to as a first embodiment, and an antenna module in which the first conductive arm 261 and second conductive arm 262 are fed by an indirectly feeding method is referred to as a second embodiment.

Furthermore, it will be described that an antenna module in which the first conductive arm 361 and second conductive arm 362 are fed by the first feeding portion 338 and second feeding portion 337, respectively, through the first and the second feeding portion 337, 338 using a direct feeding method is referred to as a third embodiment.

As a portion of supplying a current to each member being operated as a radiator, a feeding portion according to an embodiment of the present disclosure may be formed with a combination of a balun, a shifter, a divider, an attenuator, an amplifier, and the like. It will be the same for all feeding portions 137, 138, 237, 337, 338 which will be described below.

A feeding method to the conductive member 131, 231, 331 according to an embodiment of the present disclosure may not be limited in particular. For example, the feeding portion 138 and conductive member 131 may be electrically connected by a feeding line 1371 or the conductive member may be fed in an electro-magnetic (EM) feeding method. However, it will be mainly described that feeding to the conductive member 131, 331 is directly fed by the feeding line 1371, 1381, 3371, 3381 according to a first and a third embodiment of the present disclosure, and indirectly fed according to a second embodiment.

For the purpose of such direct feeding, the feeding line 1371, 1381, 3371, 3381 may include at least one of a feeding plate, a clip for feeding and a feeding line. Here, the feeding plate, clip for feeding or feeding line are electrically connected to one another to transfer a current (or voltage) fed through the feeding device to conductive members for transmitting and receiving wireless signals. Here, feeding line may include a microstrip printed on a substrate.

A method of feeding the conductive member 231 according to a second embodiment of the present disclosure is carried out by indirect feeding, but the feeding of the first and the second feeding element 241, 242 by an indirect feeding portion 237 for this purpose is carried out by a feeding line 2371, and thus, in such a context, it will be the same as the feeding line 1371, 1381, 3371, 3381.

Figure 3A:
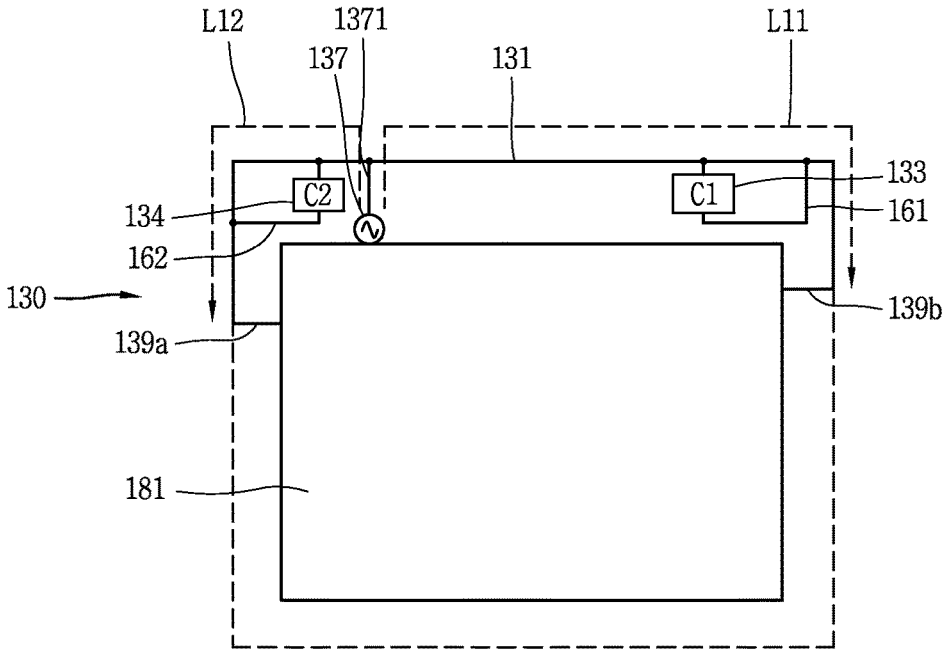
FIG. 3A is a conceptual view illustrating a fundamental type of antenna module according to a first embodiment of the present disclosure.
Figure 3B:
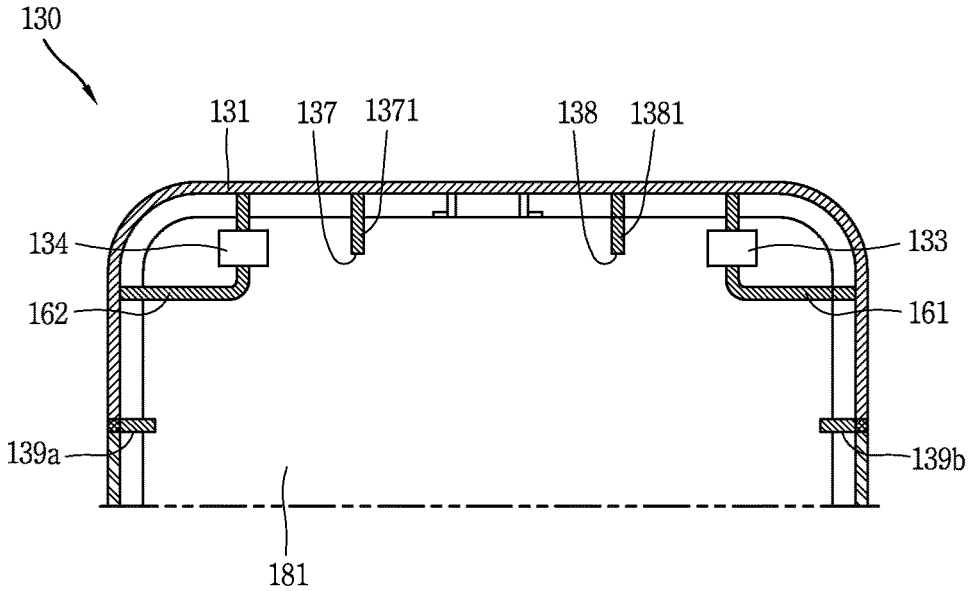
FIG. 3B is a plan view in a state that a feeding portion is added to FIG. 3A.
Figure 4:
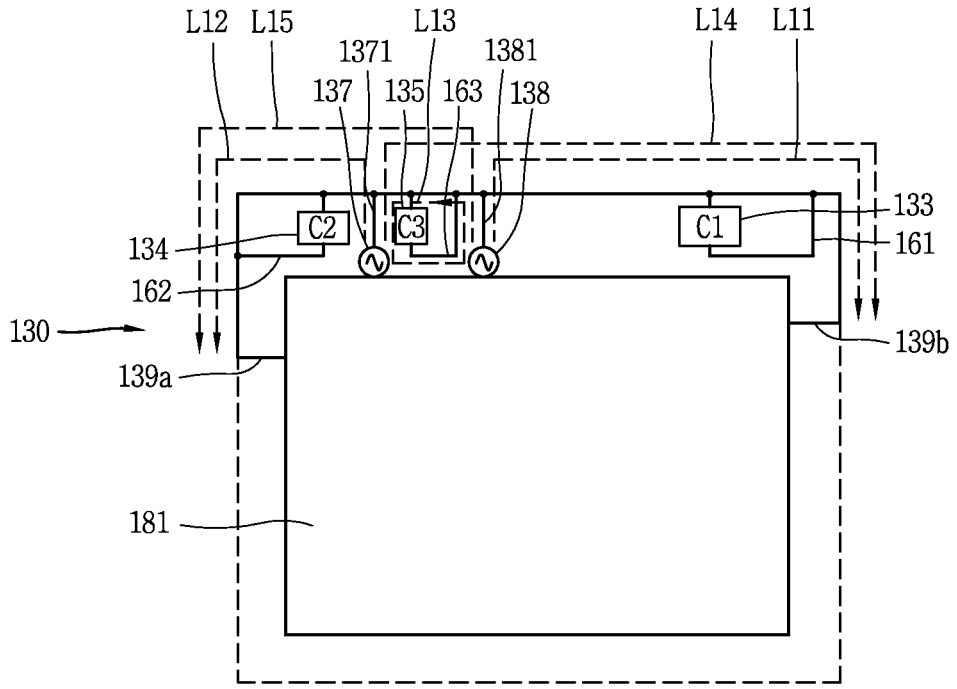
FIG. 4 is a conceptual view illustrating an antenna module in a state that a third conductive arm is added to FIG. 3B.

FIG. 3A is a conceptual view illustrating a fundamental type of antenna module 130 according to a first embodiment of the present disclosure, and FIG. 3B is a plan view in a state that a feeding portion 138 and a feeding line 1381 is added to FIG. 3A, and hereinafter, it will be described around a conceptual view like FIG. 3A. Furthermore, FIG. 4 is a conceptual view illustrating an antenna module 130 in a state that a third conductive arm 163, a third matching module 135 and a feeding portion 138 are added to FIG. 3B.

First, referring to FIGS. 3A and 3B, the antenna module 130 according to a first embodiment of the present disclosure may include a conductive member 131, a first conductive arm 161 formed at one side of the conductive member 131 to form a first loop (L11) along with the conductive member 131 so as to implement a first resonant frequency (F11), a second conductive arm 162 formed at the other side of the conductive member 131 to form a second loop (L12) along with the conductive member 131 so as to implement a second resonant frequency (F12) different from the first resonant frequency (F11), a third conductive arm 163 disposed between portions formed with the first conductive arm 161 and second conductive arm 162 on the conductive member 131 to isolate the first resonant frequency (F11) from the second resonant frequency (F12), and one or more feeding portions 137, 138 configured to feed the first conductive arm 161, second conductive arm 162 and conductive member 131.

Here, the third conductive arm 163 is also fed by the feeding portion 137, 138 to form a loop. Furthermore, the feeding portion 137, 138 may be one or two, for example, and when either one feeding portion 138 is disposed between the first conductive arm 161 and third conductive arm 163, the other one feeding portion 137 may be disposed between the second conductive arm 162 and third conductive arm 163.

However, when the third conductive arm 163 is not provided therein, it will be the same as a third embodiment of the present disclosure, and will be described later.

Hereinafter, it will be described that the feeder portion 137 disposed between the second conductive arm 162 and third conductive arm 163 is referred to as a first feeding portion, and the feeding portion 138 disposed between the first conductive arm 161 and third conductive arm 163 is referred to as a second feeding portion.

In other words, according to a first embodiment of the present disclosure, a first and a second resonant frequency (F11, F12) may be independently implemented with the first and the second conductive arm 161, 162 and only one feeding portion 137, and moreover, the first and the second resonant frequency (F11, F12) may be independently implemented by the first and the second feeding portion 137, 138.

The first conductive arm 161 and second conductive arm 162 are branched from one position of the conductive member 131 and connected again at the other position thereof. Here, the first and the second conductive arm 161, 162 may vary a physical length of the antenna to vary a bandwidth of the first and the second resonant frequency as well as vary an electrical length of the antenna by matching modules 133, 134 which will be described later to extend the first and the second resonant frequency.

Referring to FIG. 3A, a first and a second loop (L11, L12) are formed by the first feeding portion 137. In other words, the conductive member 131, the first and the second conductive arm 161, 162 are fed only by one feeding portion 137, thereby forming two loops. It has a shape in which the first conductive arm 161 and second conductive arm 162 are connected to the conductive member 131 in parallel.

Furthermore, as illustrated in FIG. 4, when the second feeding portion 138 is added to FIG. 3, and the third conductive arm 163 is added thereto, a plurality of loops are formed by the first and the second feeding portion 137, 138 and the first through the third conductive arm 161, 162, 163. The first loop (L11) is a loop formed from the second feeding portion 138 toward one side of the first conductive arm 161 along the conductive member 131 to form a first resonant frequency (F11) forming a low frequency band, and the second loop (L12) is a loop formed from the first feeding portion 137 toward one side of the second conductive arm 162 through the conductive member 131, and the third loop (L13) is a loop formed by the third conductive arm 163. Here, it may be understood that the third loop (L13) is produced only by the third conductive arm 163 in FIG. 4, but the present disclosure may not be necessarily limited to this, and should be understood as a loop formed between the first feeding line 1371 and second feeding line 1381 to have a third resonant frequency (F13) different from the first and the second resonant frequency (F11, F12).

Moreover, a fourth loop (L14) formed from the first feeding portion 137 to one side of the first conductive arm 161 through the conductive member 131 may be formed, and a fifth loop (L15) formed from the second feeding portion 138 to one side of the second conductive arm 162 through the conductive member 131 may be formed.

According to a first embodiment of the present disclosure, a first resonant frequency (F11) in a low frequency band has been implemented using the first loop (L11) and a second resonant frequency (F12) in a high frequency band has been implemented using the first loop (L11).

However, it is only one example, and a high frequency band may be implemented by the fifth loop (L15), and a resonant frequency with a low frequency band may be implemented by the fourth loop (L14). In other words, part of the first through the fifth loop (L11, L12, L13, L14, L15) may be used to implement a resonant frequency having a low frequency or high frequency band, and the low frequency and the high frequency band may be isolated using part of the loops.

However, it will be described below that a low frequency band is implemented by the first loop (L11) and a resonant frequency in a high frequency band is implemented by the second loop (L12).

The first conductive arm 161 and second conductive arm 162 may be separated from each other by a predetermined distance, and for example, may be formed at both ends of the conductive member 131. FIGS. 3A and 3B illustrate a view in which the conductive member 131 is bent, and the first conductive arm 161 and second conductive arm 162 are disposed at positions having a large separated distance, respectively. It is because the conductive member 131 should be disposed within a narrow space when formed in a mobile terminal, and thus warped with the terminal body along an external appearance of the mobile terminal, and the first conductive arm 161 and second conductive arm 162 are formed at the bent portion.

It is to independently form a first resonant frequency and a second resonant frequency, respectively, by the first conductive arm 161 and second conductive arm 162, and sufficient if allowed to implement the first resonant frequency and second resonant frequency, and not necessarily required to form the first conductive arm 161 and second conductive arm 162 at positions having the maximum separation distance on the conductive member 131.

The second feeding portion 138 may be preferably disposed at a position adjacent to the first conductive arm 161, and first feeding portion 137 disposed at a position adjacent to the second conductive arm 162, but in case of direct feeding, it may not be necessarily required to have physically close positions, and may be sufficient to have an electrically close distance. Here, it may be further lengthened by an inductive reactance element such as an inductor, and the electrical length may be further shortened by a capacitive reactance element such as a capacitor. For example, the electrical length may be further lengthened by an element obstructing the flow of electricity to enhance an electrical resistance, and the electrical length may be further shortened by an element stimulating the flow of electricity to reduce an electrical resistance.

According to a first embodiment, when the second feeding portion 138 mainly feeds the first conductive arm 161, and the first feeding portion 137 mainly feeds the second conductive arm 162, the first loop (L11) and second loop (L12) are formed in the vicinity of the first conductive arm 161 and second conductive arm 162, respectively, thereby implementing the first resonant frequency (F11) and second resonant frequency (F11) and second resonant frequency (F12), respectively, as illustrated in FIGS. 3A and 3B.

Here, the first feeding portion 137 and second feeding portion 138 may receive power from the circuit board 181 which is the ground, and both ends of the conductive member 131 may be earthed to the circuit board 181 by the ground connecting portions 139*a*, 139*b*. For example, as illustrated in FIG. 2A, the first and the second feeding portion 137, 138 are electrically connected to the circuit board 181 by the first contact terminal 138*b* and second contact terminal 138*a*, respectively.

Here, both ends of the conductive member 131 may not be necessarily required to be earthed to the circuit board 181, but may be also be open. However, both ends of the conductive member 131 may be preferably earthed to the ground.

The ground connecting portion 139*a*, 139*b* may be a screw, a C-clip, a pogo pin, an EMI sheet, or the like, and it may be the same even in case of the ground connecting portion 239*a*, 239*b*, 339*a*, 339*b* which will be described later, but the ground connecting portion 239*a*, 239*b*, 339*a*, 339*b* may not be necessarily limited to a C-clip, a pogo pin or an EMI sheet.

As in a third embodiment of the embodiments of the present disclosure which will be described later, a first resonant frequency (F31) and a second resonant frequency (F32) may be independently implemented only by feeding due to the first feeding portion 337 and second feeding portion 338. To this end, the position of the first feeding portion 237 and second feeding portion 238 is important, and for an example, an optimal position for implementing the first and the second resonant frequency (F31, F32) should be determined by the first and the second feeding portion 337, 338. However, there is a case where it is difficult to determine an optimal position of the first and the second feeding portion 337, 338, and thus according to a first embodiment of the present disclosure, it is configured that the third conductive arm 163 other than the first and the second feeding portion 137, 138 is added thereto.

In other words, as illustrated in FIG. 4, the antenna module 130 according to a first embodiment of the present disclosure may further include the third conductive arm 163 disposed between portions connected to the first feeding portion 137 and second feeding portion 138 on the conductive member 131 to form a third loop (L13) along with the conductive member 131 so as to isolate the first resonant frequency from the second resonant frequency.

When the third conductive arm 163 is formed as described above, the extent of interfering the first loop (L11) with the second loop (L12) may be further reduced. The third resonant frequency (F13) implemented by the third loop (L13) is formed between the first resonant frequency (F11) and second resonant frequency (F12). As a result, it may be possible to minimize the effects of the first loop (L11) and second resonant path (L12) from being exerted on each other.

The third conductive arm 163 according to an embodiment of the present disclosure performs a type of filter function along with a third matching module 135 which will be described later. For example, it may be a notch filter for blocking a specific frequency band, and due to this, the third conductive arm 163 may block a resonant frequency having a band between the first resonant frequency (F11) and second resonant frequency (F12) along with the third matching module 135. Due to this, the first resonant frequency (F11) and second resonant frequency (F12) can be isolated from each other. Here, a frequency band blocked by the notch filter may be a band having a predetermined range around the third resonant frequency (F13).

However, the third conductive arm 163 and third matching module 135 according to a first embodiment of the present disclosure may be a type of low pass filter for passing only resonant frequencies lower than a specific frequency without passing resonant frequencies higher than the specific frequency or a type of high pass filter for passing only resonant frequencies higher than a specific frequency without passing resonant frequencies lower than the specific frequency. In other words, the notch filter may block resonant frequencies in a specific band when the low pass filter or high pass filter is appropriately adjusted. However, it may be preferably configured with a combination of the low pass filter and high pass filter.

Moreover, the third conductive arm 163 according to an embodiment of the present disclosure may be a band pass filter for passing resonant frequencies having a specific frequency band since the blocking of resonant frequencies in a specific frequency band is only required. However, in case of a band pass filter, a resonant frequency band desired to be blocked should be appropriately shifted such that resonant frequencies desired to be blocked according to an embodiment of the present disclosure are included in the resonant frequency band blocked by the band pass filter.

Here, the third matching module 135 may be formed to include one or more lumped constant elements. For the lumped constant element, an inductor or capacitor may be used, and a conductive pattern may be formed on the circuit board 181 to operate as a capacitor and an inductor, respectively.

Furthermore, the third matching module 135 may be formed to include a capacitor, an inductor and a switching element, wherein the switching element may selectively switch the capacitor and inductor or connect the capacitor and inductor at the same time. Moreover, specific frequencies may be blocked with a combination including the inductor and/or capacitor, wherein the capacitor is a variable capacitor.

Figure 5:
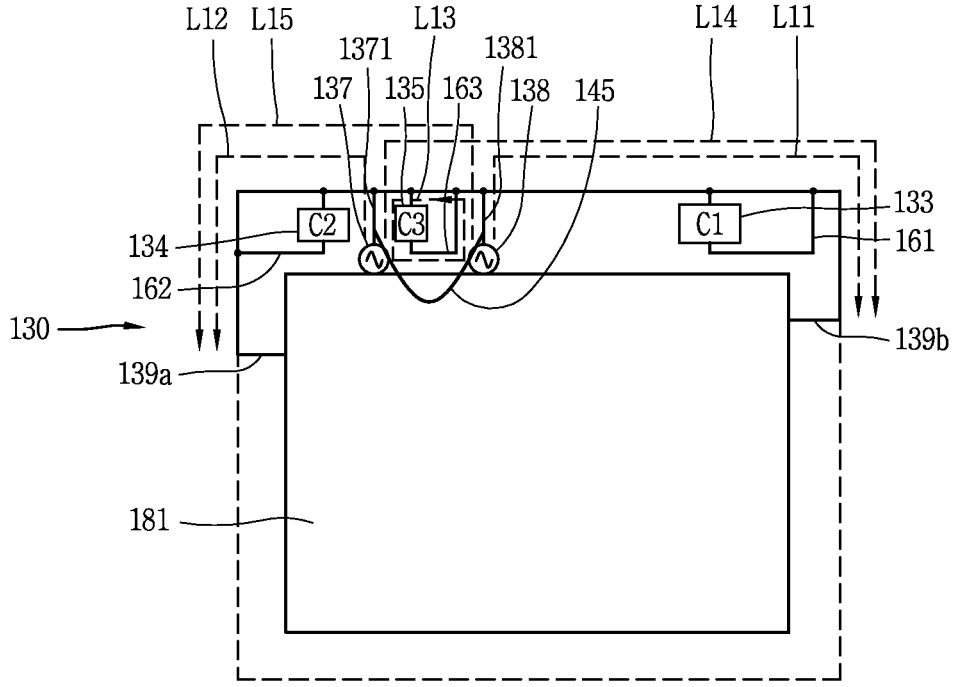
FIG. 5 is a conceptual view illustrating an antenna module in a state that a conductive line is added to FIG. 4.

However, associated with a first embodiment of the present disclosure, for the sake of convenience of explanation, it is only illustrated in FIGS. 3 through 5 that the third matching module 135 includes a capacitor. Due to this, resonant frequencies in a lower band than a specific frequency are blocked. For example, when a first resonant frequency (F11) formed by the first loop (L11) belongs to a low frequency band, and a second resonant frequency (F12) formed by the second resonant path (L12) belongs to a high frequency band, a third resonant frequency (F13) formed by the third resonant path (L13) is formed between the first resonant frequency (F11) and the second resonant frequency (F12), thereby blocking the effect of the first loop (L11) from being exerted on the second resonant path (L12).

In addition, according to a first embodiment of the present disclosure, a first and a second matching module 233, 234 are formed on the first and the second conductive arm 161, 162. Due to this, impedance matching is carried out to control the first and the second resonant frequency (F11, F12). The first through the third conductive arm 161, 162, 163 generate a self inductance phenomenon by themselves, and for LC resonance using this phenomenon, it is preferable that each of the first through the third matching module 133, 134, 135 include a capacitor. However, various commercial capacitor values are not available and their fine tuning is achieved using an inductor.

The capacitor in the first through the third matching module 133, 134, 135 includes a variable capacitor. FIG. 11 is a view illustrating a type of variable switch according to an embodiment of the present disclosure, wherein the first through the third matching module 133, 134, 135 in the present disclosure include only a capacitor (including a variable capacitor), and according to this, only a variable switch illustrated in FIGS. 11D through 11F may be applicable to the third matching module 135.

When capacitors are used for the first through the third matching module 133, 134, 135 as described above, thermal loss can be reduced compared to an inductor having a high resistance. It is similar to a second embodiment which will be described later.

Furthermore, though not shown in detail in the drawing, variable switches illustrated in FIG. 11 may be disposed in shunt with the first through the third matching module 133, 134, 135 in the first embodiment. The first through the third resonant frequency (F11, F12, F13) can be finely adjusted by the variable switches.

Furthermore, according to a first embodiment of the present disclosure, in order to further enhance isolation between the first resonant frequency and second resonant frequency, the first feeding portion 137 and second feeding portion 138 are connected by a conductive line 145 as illustrated in FIG. 5. The conductive line 145 may be a metal pattern, for example. The conductive line 145 may be directly connected to the first and the second feeding portion 137, 138, or may connect a first feeding line 1371 to a second feeding line 1381.

Here, according to a first embodiment of the present disclosure, the third conductive arm 163 may be disposed more adjacent to the first conductive arm 161 or disposed more adjacent to the second conductive arm 162. For an example, when a notch filter is used with the third matching module 135 to minimize the effect of the first resonant frequency (F11) generated by the first conductive arm 161 by the third resonant frequency (F13) generated by the third conductive arm 163 from being exerted on the second resonant frequency (F12) generated by the second conductive arm 162, the size of the third resonant frequency (F13) may be located between the first resonant frequency (F11) and second resonant frequency (F12) but located more adjacent to the first resonant frequency (F11). As a result, it may be possible to minimize an effect due to the first resonant frequency (F11). Furthermore, when the size of the third resonant frequency (F13) may be located between the first resonant frequency (F11) and second resonant frequency (F12) but located more adjacent to the first resonant frequency (F11), its effect due to the second resonant frequency (F12) can be minimized.

Here, the third resonant frequency (F13) may be formed by LC resonance, and mainly adjusted by a combination of the third matching module 135 including a self inductance (L) and a capacitor (C) of the third conductive arm 163.

When the second conductive arm 162 and third conductive arm 163 are disposed adjacent to each other as described above, it may be possible to minimize the effect of the second resonant path (L12) exerted on the first loop (L11).

Furthermore, according to an embodiment of the present disclosure, both ends of the conductive member 131 may be grounded to the circuit board 181 by the ground connecting portions 139*a*, 139*b*. The grounded position may be carried out at the outer side of portions formed with the first conductive arm 161 and second conductive arm 162, and grounded to at least one position.

If the conductive member 131 is ground-connected to the circuit board 181 by the ground connecting portions 139*a*, 139*b*, the first conductive arm 161 and second conductive arm 162 should be close to the ground connecting portions 139*a*, 139*b*.

Figure 6A:
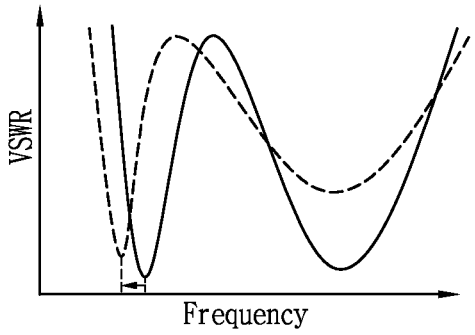
FIGS. 6A, 6B, 6C, 6D and 6E are graphs illustrating a change and a radiation efficiency of VSWR according to a frequency according to a first embodiment of the present disclosure.
Figure 6B:
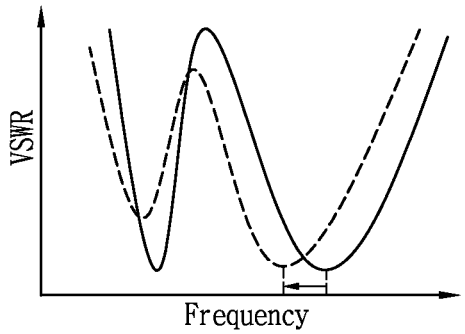

FIG. 6 is a graph illustrating a change and a radiation efficiency of voltage standing wave ratio (VSWR) according to a resonant frequency according to a first embodiment of the present disclosure, wherein FIG. 6A is a graph for explaining a shift in a first resonant frequency band due to the first conductive arm 161, and FIG. 6B is a view for explaining a shift in a second resonant frequency band due to the second conductive arm 162. Here, the first resonant frequency denotes frequencies in a low frequency band, and the second resonant frequency denotes frequencies in a high frequency band.

A graph indicated by a solid line in FIG. 6A is a graph prior to forming the first conductive arm 161 and second conductive arm 162, and a graph indicated by a dotted line is a graph in case of forming only the first conductive arm 161.

In other words, referring to FIG. 6A, it is seen that the position of a resonance point in a high frequency band is not greatly changed, but the position of a resonance point in a low frequency band has been shifted to a lower resonant frequency by forming the first conductive arm 161.

Furthermore, a graph indicated by a solid line in FIG. 6B is a graph prior to forming the second conductive arm 162, and a graph indicated by a dotted line is a graph in case of forming only the second conductive arm 162. Referring to FIG. 6B, it is seen that a change of resonance point in a low frequency band is not large, but a resonance point in a high frequency band is further decreased. In this manner, according to a first embodiment of the present disclosure, a resonance point can be changed, thereby enhancing antenna efficiency.

Figure 6C:
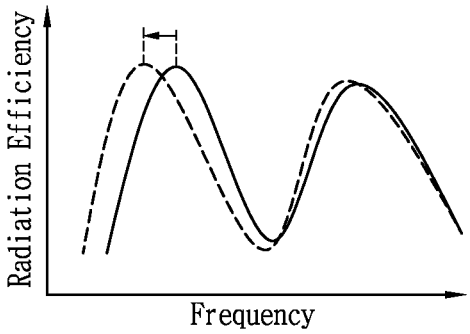
Figure 6D:
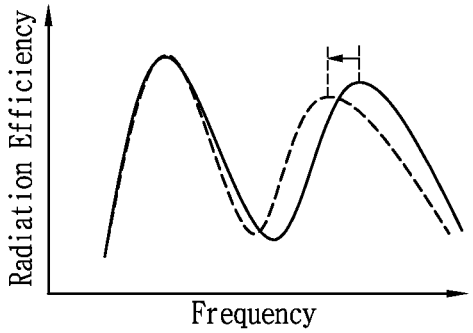

Here, FIGS. 6C and 6D are graphs illustrating a radiation efficiency according to an first embodiment of the present disclosure, wherein solid lines in FIGS. 6C and 6D are graphs prior to forming the first conductive arm 161 and second conductive arm 162, and dotted lines are graphs in case of forming only the first conductive arm 161 and a case of forming the second conductive arm 162, respectively. Referring to FIGS. 6C and 6D, it is seen that a frequency indicating the maximum efficiency has been moved to a lower frequency band.

Figure 6E:
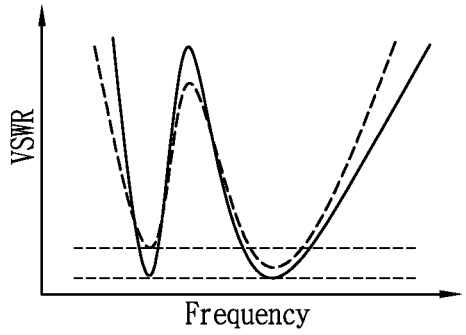

On the other hand, FIG. 6E is a graph illustrating a voltage standing wave ratio (VSWR) in case of forming only the second conductive arm 162 and a case of forming the third conductive arm 163 at one side of the second conductive arm 162, wherein a portion indicated by a dotted line is a graph in case of forming only the second conductive arm 162, and a portion indicated by a solid line is a graph in a state that the third conductive arm 163 is added. As shown in FIG. 6E, it is seen that the VSWR value is further decreased in case of forming the third conductive arm 163 compared to a case of forming only the second conductive arm 162. In other words, it is seen that isolation between the first resonant frequency (F11) and second resonant frequency (F12) is further enhanced, and this is caused by a resonant frequency blocking effect due to the third conductive arm 163.

According to a first embodiment of the present disclosure, it is illustrated that resonant frequencies in a low frequency band are implemented by the first conductive arm 161, and resonant frequencies in a high frequency band are implemented by the second conductive arm 162, but it is an example, and the first and the second resonant frequency (F11, F12) may be determined by the length of the first and the second conductive arm 161, 162. In other words, resonant frequencies in a low or high frequency band may be implemented according to the length of the first conductive arm 161 and second conductive arm 162. Furthermore, the first through the third resonant frequency (F11, F12, F13) may vary by the first through the third matching module 133, 134, 135. As a result, the first through the third resonant frequency (F11, F12, F13) may vary by a combination of the first through the third matching module 133, 134, 135 and the first through the third conductive arm 161, 162, 163. The content is similar to a second and a third embodiment which will be described later, and thus the detailed description thereof will be omitted.

Figure 7:
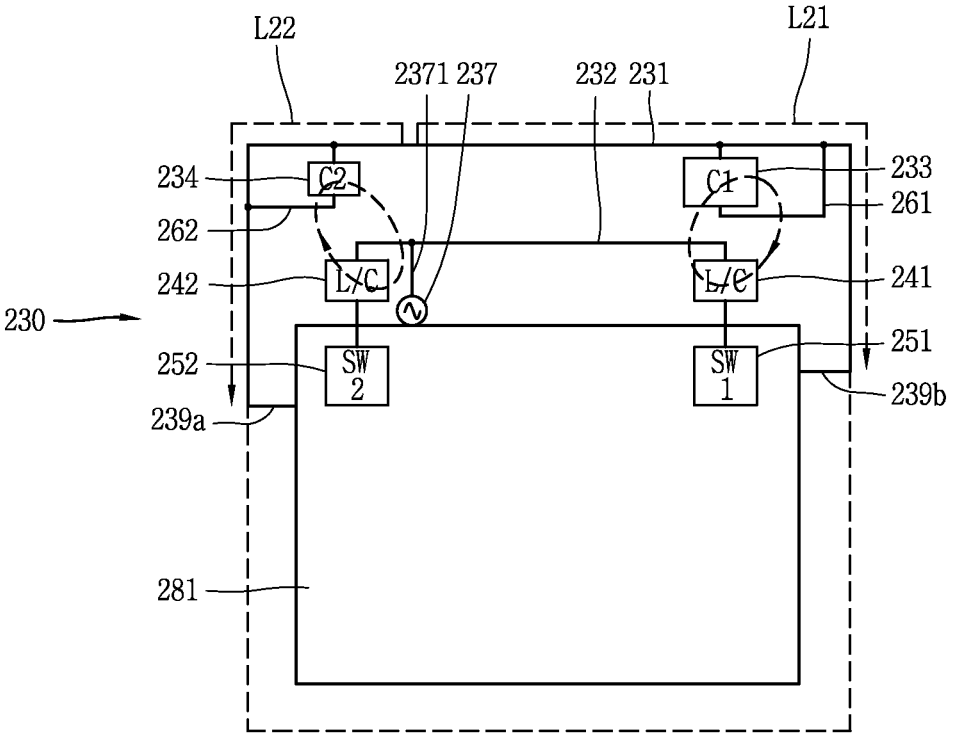
FIGS. 7 and 8 are conceptual views illustrating an antenna module according to a second embodiment of the present disclosure.
Figure 8:
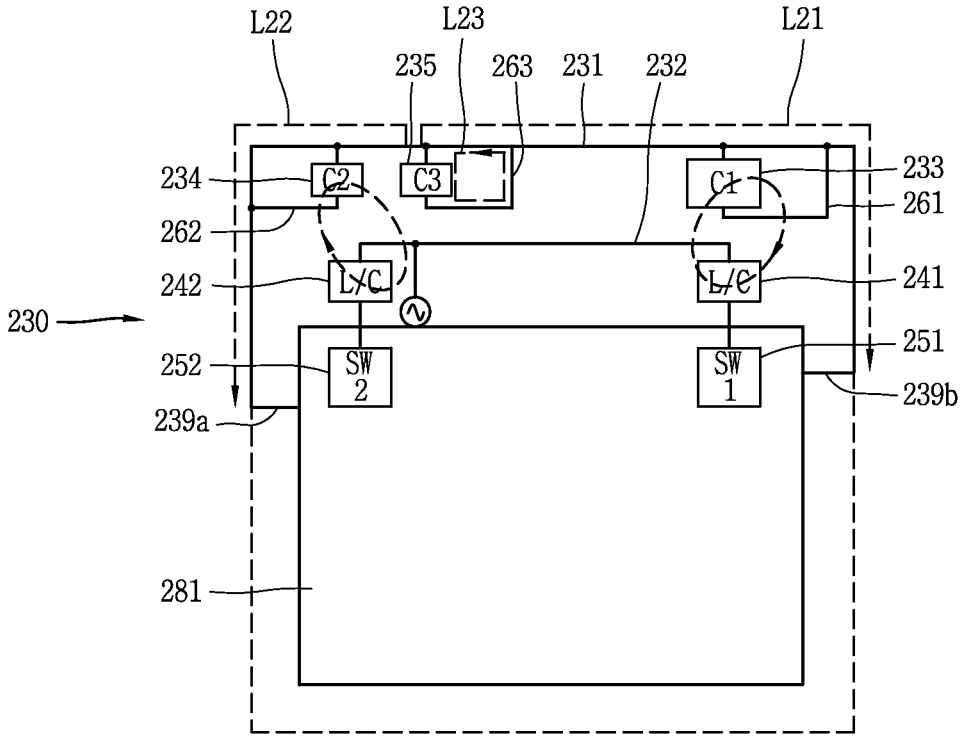

FIGS. 7 and 8 are conceptual views illustrating an antenna module according to a second embodiment of the present disclosure, and hereinafter, a second embodiment will be described with reference to FIGS. 7 and 8.

First, referring to FIG. 7, according to a second embodiment of the present disclosure, the first conductive arm 161 and second conductive arm 162 in the foregoing first embodiment may be fed by an indirect feeding method. To this end, at least one feeding portion 237 may be needed, and it is referred to as an indirect feeding portion 237 in the second embodiment.

In other words, an antenna module 230 according to a second embodiment of the present disclosure may include a conductive member 231, a first conductive arm 261 formed at one side of the conductive member 231 to form a first loop (L21) along with the conductive member 231 so as to implement a first resonant frequency (F21), a second conductive arm 262 formed at the other side of the conductive member 231 to form a second loop (L22) along with the conductive member 231 so as to implement a second resonant frequency (L21), and an indirect feeding portion 237 configured to indirectly feed the first and the second conductive arm 261, 262.

The position of the conductive member 231, first conductive arm 261 and second conductive arm 262 is the same as that of the first embodiment, and a frequency band desired to be implemented is similar thereto, and thus it will be described around the other portion of the first embodiment. Even in case of the first through the third matching module 233, 234, 235 formed on the first through the third conductive arm 261, 262, 263, it is the same as that of the first embodiment, and thus the detailed description thereof will be omitted, and substituted by the description of the first embodiment.

A first feeding element 241 disposed adjacent to the first conductive arm 261 to indirectly feed the first conductive arm 261 and a second feeding element 242 disposed adjacent to the second conductive arm 262 to indirectly feed the second conductive arm 262 are formed on the indirection feeding portion 237. In other words, according to a second embodiment, a feeding element may be needed to feed the first conductive arm 261 and second conductive arm 262, and indirect feeding is generated by the feeding element to feed the first conductive arm 261 and second conductive arm 262. The indirect feeding herein denotes an electromagnetic coupling.

The first feeding element 241 and second feeding element 242 may include a lumped constant element, and for example, the first feeding element 241 and second feeding element 242 may be configured with a combination of a capacitor and an inductor. A first variable switch 251 and a second variable switch 252 connected to the ground, respectively, are formed on the first and the second feeding element 241, 242 to tune a resonant frequency. The variable switches 251, 252 herein may be configured with a combination including an inductor and/or a capacitor as illustrated in FIG. 11.

FIG. 11 is a view illustrating a type of variable switch according to an embodiment of the present disclosure, in which the variable switch can be configured with various combinations of a capacitor and an inductor. For example, the variable switch may have different inductors as illustrated in FIG. 11A, or have an inductor and a capacitor as illustrated in FIG. 11B, or have only an inductor as illustrated in FIG. 11C. Furthermore, an inductor and a capacitor may be connected in series as illustrated in FIG. 11D, and the variable switch may have a variable capacitor as illustrated in FIG. 11E, and an inductor and a variable capacitor may be connected in parallel as illustrated in FIG. 11F.

The foregoing examples illustrate only one example, and a variable inductor may be used, and a single pole double throw (SPDT) switch and a single pole triple throw (SP3T) switch may be also used.

Such a variable switch will be apparent to those skilled in the art, and thus the detailed description thereof will be omitted.

In this manner, according to a second embodiment of the present disclosure, the first feeding element 241 and second feeding element 242 are configured with a combination including an inductor and a capacitor, which are lumped constant elements, and ground-connected to the ground through the first variable switch 251 and second variable switch 252.

Figure 9:
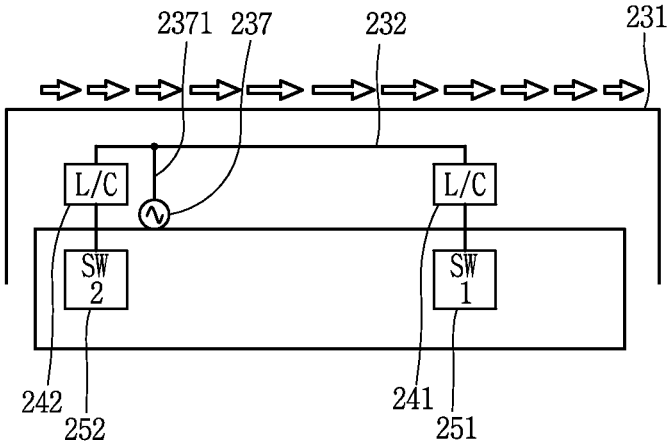
FIG. 9 is a view for explaining a model in which a current in a second embodiment of the present disclosure is induced.

The second embodiment of the present disclosure may use an indirect feeding method, which is an area to area feeding, and thus a current induced to the conductive member 231 may be uniform, thereby securing stable wireless performance. In other words, as illustrated in FIG. 9, the intensity of a current induced to the conductive member 231 may be uniform, and thus it is seen that the current is smoothly induced without reducing a body effect or being induced to one place in a concentrated manner. Here, an arrow shown in FIG. 9 indicates the intensity of a current induced to the conductive member 231.

Furthermore, the first and the second feeding element 241, 242 may be disposed on a conductive connecting member 232 for connecting the first and the second feeding element 241, 242 to the indirect feeding portion 237. Here, indirect feeding according to a second embodiment of the present disclosure may be an electromagnetic coupling. Here, the first variable switch 251 and second variable switch 252 may control the electromagnetic coupling to adjust the impedance.

The first conductive arm 261 and second conductive arm 262 implement a first resonant frequency (F21) and a second resonant frequency (F22), respectively, wherein the first resonant frequency band denotes a low frequency band, and the second resonant frequency band denotes a high frequency band. However, though not necessarily carried out as described above, hereinafter, for the sake of convenience of explanation, it will be described on the assumption that the second resonant frequency is a high frequency.

Referring to FIG. 7, it is seen that the indirect feeding portion 237 is disposed more adjacent to the second feeding element 242, and fine tuning is allowed by changing the position of the indirect feeding portion 237.

The first and the second loop (L21, L22) may be formed by the indirect feeding portion 237, wherein the first loop (L21) is formed at one side of the first conductive arm 261 from a position which is the closest to the indirect feeding portion 237 on the conductive member 231 through the conductive member 231, and the second loop (L22) is formed at one side of the second conductive arm 262 from a position which is the closest to the indirect feeding portion 237 on the conductive member 231 through the conductive member 231. Here, the first and the second loop (L21, L22) may be formed in opposite directions to each other, and crossed at the closest position to the indirect feeding portion 237 of the conductive member 231.

According to a second embodiment, the first conductive arm 261 and second conductive arm 262 may be fed by an indirect feeding method, and the first loop (L21) formed on the first conductive arm 261 and the second loop (L22) formed on the second conductive arm 262 may exert effects on each other. According to a second embodiment of the present disclosure, a third conductive arm 263 is added to minimize interference between the first loop (L21) and the second loop (L22). In other words, as illustrated in FIG. 8, an antenna module 230 according to a second embodiment may further include a third conductive arm 263 disposed between the first conductive arm 261 and second conductive arm 262 of the conductive member 231 to form a third loop (L23) along with the conductive member 231 so as to implement a third resonant frequency (F23) and isolate the first resonant frequency (F21) from the second resonant frequency (F22). The third loop (L23) is formed by allowing a current flowing through the conductive member 231 to be branched to the third conductive arm 263 and then to flow through the conductive member 231 again.

The third loop (L23) is used for the purpose of isolating the first and the second resonant frequency (F21, F22) rather than using it according to an embodiment. However, the present disclosure may not be necessarily limited to this, and the third resonant frequency (F23) may form part of a resonant frequency band used in a mobile terminal. It is similar to the first and the third embodiment of the present disclosure.

The third loop (L23) is implemented by the third conductive arm 263 to form the third resonant frequency (F23) by the third loop (L23). Here, the third resonant frequency (F23) is formed between the first resonant frequency (F21) and second resonant frequency (F22). Furthermore, the third conductive arm 263 may be formed more adjacent to the first conductive arm 261 or formed more adjacent to the second conductive arm 262. For example, the third conductive arm 263 should be disposed more adjacent to the first conductive arm 261 than the second conductive arm 262 to minimize an effect on the second loop (L22) due to the first loop (L21), and the third conductive arm 263 may be formed more adjacent to the first conductive arm 261 or formed more adjacent to the second conductive arm 262, and the third conductive arm 263 should be formed more adjacent to the second conductive arm 262 than the first conductive arm 261 to minimize an effect on the first loop (L21) due to the second loop (L22). In this manner, the first resonant frequency (F21) is isolated from the second resonant frequency (F22).

Here, a first through a third matching module 233, 234, 235 are formed on the first through the third conductive arm 261, 262, 263, respectively, and impedance matching is carried out by them.

The third conductive arm 263 and third matching module 235 may be a notch filter as in the first embodiment. Moreover, they may be configured with a combination of a low pass filter and a high pass filter, and may be a band pass filter as described in the first embodiment.

Here, the first and the second feeding element 241, 242 are disposed on a conductive connecting member 232 for connecting the first and the second feeding element 241, 242 to the indirect feeding portion 237.

Figure 10A:
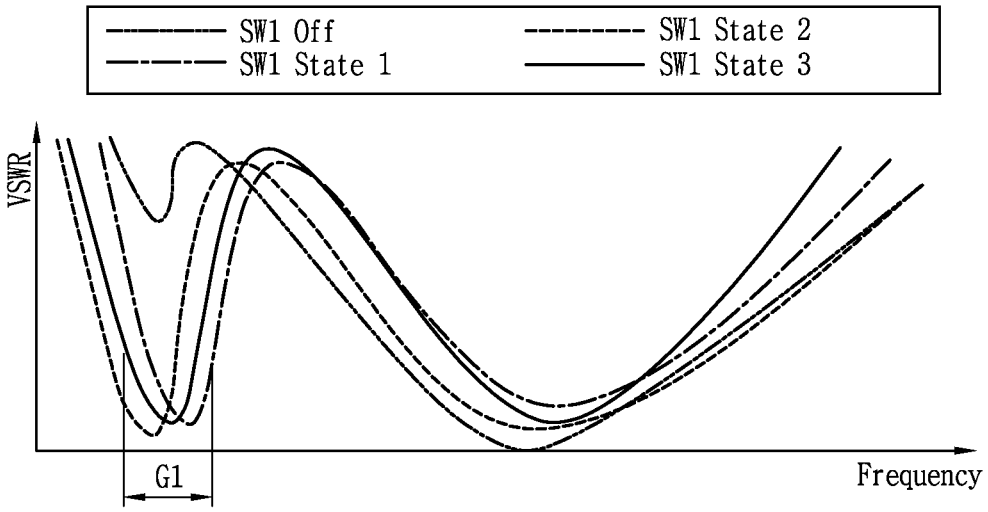
FIGS. 10A and 10B are graphs illustrating a VSWR according to a frequency in a second embodiment of the present disclosure.
Figure 10B:
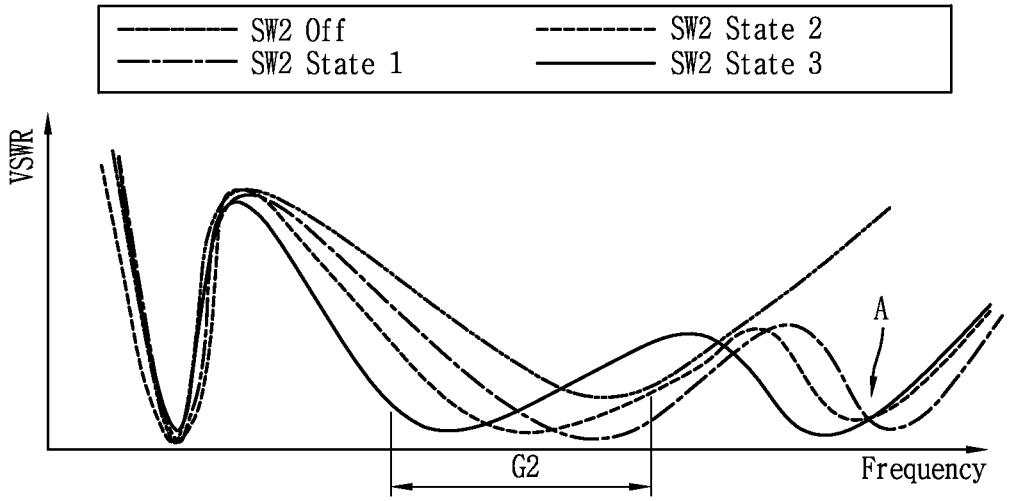
Figure 11A:
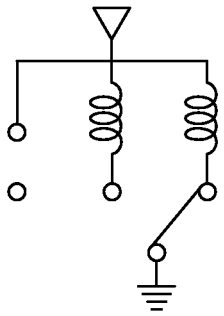
FIGS. 11A, 11B, 11C, 11D, 11E and 11F are views illustrating a type of variable switch according to an embodiment of the present disclosure.
Figure 11B:
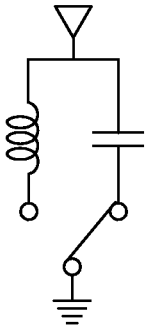
Figure 11C:
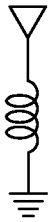
Figure 11D:
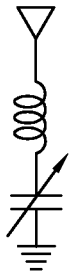
Figure 11E:
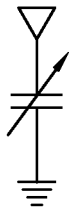
Figure 11F:
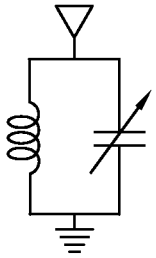

FIG. 10 is a graph illustrating a VSWR according to a frequency in a second embodiment of the present disclosure. First, FIG. 10A is a graph illustrating a VSWR according to the state of the first variable switch 251 while the second variable switch 252 for controlling the second feeding element 242 is off, and FIG. 10B is a graph illustrating a VSWR according to the state of the second variable switch 252 while the first variable switch 251 is fixed.

Referring to FIG. 10A, it is seen that a wider bandwidth (G1) can be secured in a lower frequency band according to a change of the state of the first variable switch 251 while matching is not well carried out in a state that the first variable switch 251 for controlling the first feeding element 241 is open and off.

In other words, the first variable switch 251 may be controlled to implement frequencies having a wider band. However, a value in a high frequency band herein does not show a big difference.

Furthermore, referring to FIG. 10B, it is seen that a bandwidth (G2) in a high frequency band can be extended when the first variable switch 251 is fixed, and the state of the second variable switch 252 is varied. In addition, it is seen that an additional band (A) is formed by a high frequency. It is caused by resonance due to the indirect feeding portion 237.

Furthermore, according to a second embodiment of the present disclosure, the conductive member 231 may be fed by an indirect feeding method to secure a wider bandwidth than that of feeding due to a direct feeding method, and the first conductive arm 261 and second conductive arm 262 may have the same loop structure to facilitate the transfer of signals. Here, the conductive connecting member 232 and the first and the second feeding element 241, 242 connected to the indirect feeding portion 237 is earthed and connected to the ground by the first and the second variable switch 251, 252 and the conductive member 231 is earthed and connected by the ground connecting portion 239*a*, 239*b*.

Even in the second embodiment of the present disclosure, the first conductive member 231 may form a lateral appearance of the mobile terminal. Here, the first conductive member 231 may form part or all of a lateral surface of the mobile terminal, and when part of all of the lateral surface of the mobile terminal is formed with the same material, it is preferably earthed and connected to the ground at one position of the first conductive member 231.

Figure 12:
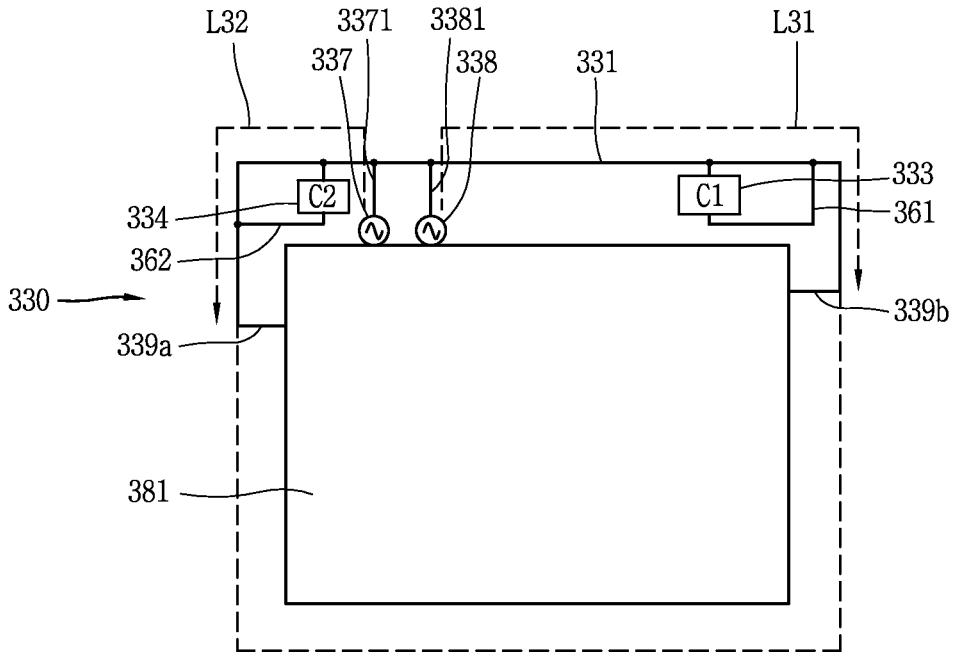
FIG. 12 is a conceptual view illustrating an antenna module according to a third embodiment of the present disclosure.

Furthermore, FIG. 12 is a conceptual view illustrating an antenna module according to a third embodiment of the present disclosure, and hereinafter, the third embodiment will be described with reference to FIG. 12.

According to a third embodiment of the present disclosure, an antenna module 330 having two feeding portions 337, 338 for directly feeding a conductive member 331, and a first and a second conductive arm 361, 362 is provided.

In other words, the antenna module 330 according to a third embodiment may include a conductive member 331, a first conductive arm 361 formed at one side of the conductive member 331 to form a first loop (L31) along with the conductive member 331 so as to implement a first resonant frequency (F31), a second conductive arm 362 formed at the other side of the conductive member 331 to form a second loop (L32) along with the conductive member 331 so as to implement a second resonant frequency (F32), a first feeding portion 337 formed adjacent to the second conductive arm 362 to feed the second conductive arm 362 and conductive member 331, and a second feeding portion 338 formed adjacent to the first conductive arm 361 to feed the first conductive arm 361 and conductive member 331.

In this manner, according to a third embodiment, the second conductive arm 362 is mainly fed by the first feeding portion 337, and the first conductive arm 361 is mainly fed by the second feeding portion 338. It denotes that the second conductive arm 362 is mainly fed by the first feeding portion 337, and the first conductive arm 361 is mainly fed by the second feeding portion 338, but does not denote that the first feeding portion 337 does not feed the first conductive arm 361. In other words, the first and the second feeding portion 337, 338 may feed all the conductive member 331, and the first and the second conductive arm 361, 362. However, loops implementing a resonant frequency required for the third embodiment of the present disclosure are the first and the second loop (L31, L32), and hereinafter, as illustrated in FIG. 12, it will be mainly described that the first feeding portion 337 feeds the second conductive arm 362, and the second feeding portion 338 feeds the first conductive arm 361. Even herein, the length of a loop may be changed according to the location of the first and the second feeding portion 337, 338 to change a resonant frequency.

Here, even in the third embodiment of the present disclosure, the conductive member 331 may form a lateral appearance of the mobile terminal. Here, the first conductive member 331 may form part or all of a lateral surface of the mobile terminal, and when part of all of the lateral surface of the mobile terminal is formed with the same material, it is preferably earthed and connected to the ground at one position of the first conductive member 331.

Here, the first and the second loop (L31, L32) are formed on the first and the second conductive arm 361, 362, respectively, wherein the first loop (L31) is formed from the second feeding portion 338 to one side of the first conductive arm 361 through the conductive member 331, and the second loop (L32) is formed from the first feeding portion 337 to one side of the second conductive arm 362 through the conductive member 331.

The first and the second resonant frequency (F31, F32) are implemented by the first and the second loop (L31, L32). Even in the third embodiment, the first resonant frequency (F31) denotes frequencies in a low frequency band, and the second resonant frequency (F32) denotes frequencies in a high frequency band.

When the first and the second feeding portion 337, 338 are disposed at an optimal position, the first and the second resonant frequency (F31, F32) may be independently implemented without being exerted on each other, but even in the third embodiment of the present disclosure, a first and a second matching module 333, 334 may be added to more easily isolate the first and the second resonant frequency (F31, F32).

Even herein, the first and the second matching module 333, 334 may be formed to include one or more lumped constant elements, and for the lumped constant element, an inductor or capacitor may be used, and a conductive pattern may be formed on the circuit board 381 to operate as a capacitor and an inductor, respectively.

Hereinafter, a mobile terminal 100 having an antenna module 130, 230, 330 according to the first through the third embodiment will be described.

The conductive member 131, 231, 331 according to an embodiment of the present disclosure may form a lateral appearance of the mobile terminal. Here, the conductive member 131, 231, 331 may form part or all of a lateral surface of the mobile terminal, and when part of all of the lateral surface of the mobile terminal is formed with the same material, it is preferably earthed and connected to the ground at one position of the conductive member 131, 231, 331. It is to easily vary a resonant frequency by limiting the size of the antenna module 130, 230, 330.

Moreover, the conductive member 131, 231, 331 may be formed on an inner or outer surface of the rear case 102, and may not be necessarily formed on the outermost thereof even when forming a lateral surface of the terminal body. For example, the conductive member 131, 231, 331 may form a lateral surface of the terminal body, and an injection molded body may be formed on a lateral outermost thereof, and the conductive member 131, 231, 331 may be formed within the injection molded body.

FIG. 2A is a view associated with a first embodiment of the present disclosure, and FIG. 2B is a view associated with a second embodiment of the present disclosure. As illustrated in FIGS. 2A and 2B, the conductive member 131, 231 may form a lateral appearance of the mobile terminal. The third embodiment is similar to the first embodiment, and thus the drawings thereof will be omitted, and a description redundant to the first embodiment will be substituted by the description of the first embodiment.

In other words, according to a first through a third embodiment of the present disclosure, when the conductive member 131, 231, 331 forms the entire lateral appearance of the terminal body, the integrity of exterior design may be maintained. However, here, the ground connecting portion 139*a*, 139*b*, 239*a*, 239*b*, 339*a*, 339*b* may be ground-connected to the conductive member 131, 231, 331, and thus the antenna module 130, 230, 330 may be electrically isolated from the remaining portion 102*b* (refer to FIGS. 2A and 2B) excluding the conductive member 131, 231, 331.

Here, the conductive member 131, 231, 331 may form part of a lateral appearance of the terminal body, and may be isolated from the remaining portion 102*b* by an insulating material. The remaining portion 102*b* may be a metal deco.

Furthermore, the remaining portion 102*b* may form the rear case 102 along with the conductive member 131, 231, 331. In other words, the remaining portion 102*b* may be connected to the conductive member 131, 231, 331 to form a lateral appearance of the terminal body.

Here, the remaining portion 102*b* may be formed in a loop shape connected to the conductive member 131, 231, 331, and may be formed with the rear case 102 that is integrally formed by insert injection.

Hereinafter, a mobile terminal according to an embodiment of the present disclosure will be described in more detail.

The mobile terminal 100 according to an embodiment of the present disclosure may include a terminal body, and an antenna module 130, 230, 330 provided in the terminal body to implement a first resonant frequency (F11, F21, F31) and a second resonant frequency (F21, F22, F23) which is different from the first resonant frequency (F11, F21, F31).

The antenna module 130, 230, 330 may be at least one of antenna modules in the first through the third embodiment, the antenna module 130, 230, 330 may include a conductive member 131, 231, 331 formed on a lateral outside of the terminal body, a first conductive arm 161, 261, 361 formed at one side of the conductive member 131, 231, 331 to form a first loop (L11, L21, L31) along with the conductive member 131, 231, 331 so as to implement a first resonant frequency (F11, F21, F31), a second conductive arm 162, 262, 362 formed at the other side of the conductive member 131, 231, 331 to form a second loop (L21, L22, L32) along with the conductive member 131, 231, 331 so as to implement a second resonant frequency (F12, F22, F32), and a feeding portion 137, 138, 237, 337, 338 formed adjacent to the first conductive arm 161, 261, 361 or second conductive arm 162, 262, 362 to directly or indirectly feed the first conductive arm 161, 261, 361, second conductive arm 162, 262, 362 and conductive member 131, 231, 331.

Here, the first conductive arm 161, 261, 361 and second conductive arm 162, 262, 362 are isolated by the feeding portion 137, 138, 237, 337, 338. Furthermore, in order to well isolate the first conductive arm 161, 261 and second conductive arm 162, 262, the antenna module may further include a third conductive arm 163, 263 disposed between the first conductive arm 161, 261 and second conductive arm 162, 262 of the conductive member 131, 231 to form a third loop (L13, L23) along with the conductive arm 131, 231 to implement a third resonant frequency (F13, F23).

When directly feeding the first conductive arm 161, 361, second conductive arm 162, 362 and conductive member 131, 331, the feeding portion may include a first feeding portion 137, 337 disposed adjacent to the second conductive arm 162, 362 and a second feeding portion 138, 338 disposed adjacent to the first conductive arm 161, 361. Here, the first conductive arm 161, second conductive arm 162 and conductive member 131 may be directly fed by only one feeding portion 137 or 138.

Furthermore, when indirectly feeding the first through the third conductive arm 261, 262, 362 and conductive member 231, the feeding portion may include an indirect feeding portion 237, a first feeding element 241 connected to the indirect feeding portion 237, and disposed adjacent to the first conductive arm 261 to indirectly feed the first conductive arm 261, and a second feeding element 242 disposed adjacent to the second conductive arm 262 to indirectly feed the second conductive arm 262.

The foregoing present invention may be implemented as codes readable by a computer on a medium written by the program. The computer-readable media may include all kinds of recording devices in which data readable by a computer system is stored. Examples of the computer-readable media may include a hard disk drive (HDD), a solid state disk (SSD), a silicon disk drive (SDD), a ROM, a RAM, a CD-ROM, a magnetic tape, a floppy disk, and an optical data storage device, and the like, and also include a device implemented in the form of a carrier wave (for example, transmission via the Internet). In addition, the computer may include the controller 180 of the mobile terminal. Accordingly, the detailed description thereof should not be construed as restrictive in all aspects but considered as illustrative. The scope of the invention should be determined by reasonable interpretation of the appended claims and all changes that come within the equivalent scope of the invention are included in the scope of the invention.

What is claimed is:

1. An antenna module, comprising:

a conductive member having a first side and a second side;

a first conductive arm formed at the first side of the conductive member to form a first loop along with the conductive member to implement a first resonant frequency;

a second conductive arm formed at the second side of the conductive member to form a second loop along with the conductive member to implement a second resonant frequency;

a third conductive arm formed with the conductive member and located between the first conductive arm and the second conductive arm to isolate the first resonant frequency from the second resonant frequency; and a first feeding portion located between the first conductive arm and the third conductive arm, or located between the second conductive arm and the third conductive arm, to feed the first conductive arm, the second conductive arm, and the conductive member.

2. The antenna module of claim 1, further comprising:

a first, second, and third matching module each respectively formed on the first conductive arm, the second conductive arm, and the third conductive arm.

3. The antenna module of claim 2, further comprising:

a second feeding portion located between the first conductive arm and the third conductive arm, or located between the second conductive arm and the third conductive arm, to feed the first conductive arm, the second conductive arm and the conductive member, wherein the second feeding portion is formed at both sides of the third conductive arm along with the first feeding portion.

4. The antenna module of claim 3, wherein the first feeding portion and the second feeding portion are connected by a conductive line.

5. The antenna module of claim 3, wherein the first feeding portion and the second feeding portion are formed adjacent to the first conductive arm or the second conductive arm.

6. The antenna module of claim 2, wherein each of the first, the second, and the third matching modules comprises a capacitor.

7. The antenna module of claim 6, wherein the third conductive arm and the third matching module form a notch filter.

8. The antenna module of claim 6, wherein each of the first resonant frequency and the second resonant frequency varies by the capacitor and a self inductance, respectively.

9. The antenna module of claim 1, wherein the conductive member is earthed to ground at at least one position on an outer side of portions formed with the first conductive arm and the second conductive arm.

10. The antenna module of claim 9, wherein the location of the first conductive arm and the second conductive arm is formed at an end of the conductive member when the conductive member is earthed.

11. An antenna module, comprising:

a conductive member having a first side and a second side;

a first conductive arm formed at the first side of the conductive member to form a first loop along with the conductive member to implement a first resonant frequency;

a second conductive arm formed at the second side of the conductive member to form a second loop along with the conductive member to implement a second resonant frequency; and an indirect feeding portion configured to indirectly feed the first conductive arm and the second conductive arm;

a first feeding element located adjacent to the first conductive arm to indirectly feed the first conductive arm; and a second feeding element located adjacent to the second conductive arm to indirectly feed the second conductive arm, wherein the first feeding element and the second feeding element are formed on the indirection feeding portion.

12. The antenna module of claim 11, wherein the indirect feeding portion is formed adjacent to the first conductive arm or the second conductive arm.

13. The antenna module of claim 12, further comprising:

a third conductive arm located between the first conductive arm and the second conductive arm of the conductive member to form a third loop along with the conductive member to isolate the first resonant frequency from the second resonant frequency.

14. The antenna module of claim 13, a first, second, and third matching module each respectively formed on the first conductive arm, the second conductive arm, and the third conductive arm.

15. The antenna module of claim 14, wherein each of the first, the second, and the third matching module comprises a capacitor.

16. The antenna module of claim 11, wherein a first variable switch and a second variable switch each connected to ground are respectively formed on the first feeding element and the second feeding element to respectively tune the first resonant frequency and the second resonant frequency.

17. The antenna module of claim 11, wherein each of the first feeding element and the second feeding element comprise an inductor and a capacitor.

18. The antenna module of claim 11, wherein the first feeding element and the second feeding element are located on a conductive connecting member connecting the first feeding element and the second feeding element to the indirect feeding portion.

19. The antenna module of claim 11, wherein the conductive member is earthed to ground at at least one position on an outer side of portions formed with the first conductive arm and the second conductive arm.

20. An antenna module, comprising:

a conductive member having a first side and a second side;

a first conductive arm formed at the first side of the conductive member to form a first loop along with the conductive member to implement a first resonant frequency;

a second conductive arm formed at the second side of the conductive member to form a second loop along with the conductive member to implement a second resonant frequency;

a first feeding portion formed adjacent to the second conductive arm to feed the second conductive arm and the conductive member; and a second feeding portion formed adjacent to the first conductive arm to feed the first conductive arm and the conductive member, wherein the first resonant frequency and the second resonant frequency are isolated by the first feeding portion and the second feeding portion.

21. The antenna module of claim 20, wherein a first matching module and a second matching module are respectively formed on the first conductive arm and the second conductive arm.

22. The antenna module of claim 21, wherein each of the first matching module and the second matching module comprises a capacitor.

23. A mobile terminal, comprising:

a terminal body; and an antenna module provided on the terminal body to implement a first resonant frequency and a second resonant frequency different from the first resonant frequency, wherein the antenna module comprises:

a conductive member formed on a lateral outside of the terminal body and having a first side and a second side;

a first conductive arm formed at the first side of the conductive member to form a first loop along with the conductive member to implement a first resonant frequency;

a second conductive arm formed at the second side of the conductive member to form a second loop along with the conductive member to implement a second resonant frequency; and a feeding portion formed adjacent to the first conductive arm or the second conductive arm to feed the first conductive arm, the second conductive arm and the conductive member.

24. The mobile terminal of claim 23, further comprising:

a third conductive arm located between the first conductive arm and the second conductive arm of the conductive member to form a third loop along with the conductive member to isolate the first resonant frequency from the second resonant frequency.

25. The mobile terminal of claim 24, wherein when the first conductive arm, the second conductive arm and the conductive member are directly fed, the feeding portion comprises a first feeding portion located between the second conductive arm and the third conductive arm, and a second feeding portion located between the first conductive arm and the third conductive arm.

26. The mobile terminal of claim 24, wherein when the first conductive arm, the second conductive arm and the conductive member are indirectly fed, the feeding portion is an indirect feeding portion, and a first feeding element located adjacent to the first conductive arm to indirectly feed the first conductive arm, and a second feeding element located adjacent to the second conductive arm to indirectly feed the second conductive arm, are connected to the indirect feeding portion.

27. The mobile terminal of claim 24, further comprising:

a first, second, and third matching module each respectively formed on the first conductive arm, the second conductive arm, and the third conductive arm.

28. The mobile terminal of claim 27, wherein each of the first, the second, and the third matching modules comprises a capacitor.

29. The mobile terminal of claim 23, wherein the conductive member is formed over part or all of the terminal body.

* * * * *